US007942684B1

(12) United States Patent
Beak et al.

(10) Patent No.: US 7,942,684 B1
(45) Date of Patent: May 17, 2011

(54) CONNECTOR DEVICE, RECEIVING CONNECTOR, AND INSERTING CONNECTOR

(75) Inventors: Seung Seok Beak, Shinagawa (JP); Koichi Kiryu, Shimotakai-gun (JP); Keiichi Hirose, Minato-ku (JP); Tomonori Iino, Minato-ku (JP)

(73) Assignees: Fujitsu Component Limited, Tokyo (JP); NTT Facilities, Inc., Tokyo (JP)

( * ) Notice: Subject to any disclaimer, the term of this patent is extended or adjusted under 35 U.S.C. 154(b) by 0 days.

(21) Appl. No.: 12/839,505

(22) Filed: Jul. 20, 2010

(30) Foreign Application Priority Data

Nov. 13, 2009 (JP) ..... 2009-259731

(51) Int. Cl.
*H01R 33/96* (2006.01)

(52) U.S. Cl. ..... 439/188; 200/51.12

(58) Field of Classification Search ..... 200/51 R, 200/51.11, 51.12; 439/188
See application file for complete search history.

(56) References Cited

U.S. PATENT DOCUMENTS 6,495,775 B2 * 12/2002 Lawson et al. ..... 200/50.28
6,878,889 B1 * 4/2005 Horst et al. ..... 200/51.11
7,544,909 B2 * 6/2009 Dhir ..... 200/51.12
7,789,685 B2 * 9/2010 Hickam ..... 439/188
2004/0099516 A1 * 5/2004 Bang ..... 200/51 R
2008/0099313 A1 * 5/2008 Dhir ..... 200/51.12
2010/0029110 A1 * 2/2010 Kiryu et al. ..... 439/188
2010/0029111 A1 * 2/2010 Yuba et al. ..... 439/188

FOREIGN PATENT DOCUMENTS

JP 05-82208 4/1993
JP 2003-31301 1/2003

* cited by examiner

*Primary Examiner* — Gary F. Paumen

(74) *Attorney, Agent, or Firm* — IPUSA, PLLC

(57) ABSTRACT

A connector device includes an inserting connector and a receiving connector, wherein the receiving connector is connected to the electronic device; the receiving connector includes a single control plug terminal and two electric power jack terminals made of a conductor material, the electric power jack terminals being configured to receive the supply of the electric power; the control plug terminal can be extended and retracted in an inserting direction of the receiving connector; the inserting connector is connected to the electric power source; the inserting connector includes a control jack terminal corresponding to the control plug terminal and two electric power plug terminals corresponding to the two electric power jack terminals; and the control jack terminal includes a control switch.

33 Claims, 20 Drawing Sheets

(a)

(b)

(a)

(b)

CONNECTOR DEVICE, RECEIVING CONNECTOR, AND INSERTING CONNECTOR

CROSS-REFERENCE TO RELATED APPLICATIONS

This patent application is based upon and claims the benefit of priority of Japanese Patent Application No. 2009-259731 filed on Nov. 13, 2009 the entire contents of which are incorporated herein by reference.

BACKGROUND OF THE INVENTION

1. Field of the Invention

The present invention generally relates to connector devices, receiving connectors, and inserting connectors. More specifically, the present invention relates to a connector device, a receiving connector, and an inserting connector which are used for supplying electric power.

2. Description of the Related Art

It is general practice that electronic devices are operated by receiving supplies of electric power from electric power sources. It is also general practice that the electronic device receives the supply of the electric power from the electric power source via a connector device.

In the connector device, as discussed in Japanese Laid-Open Patent Application Publication No. 5-82208 and Japanese Laid-Open Patent Application Publication No. 2003-31301, an inserting connector and a receiving connector are engaged with each other so that electric connection is made.

On the other hand, in recent years, in electric power transmission in a local area, supply of high voltage and direct current electric power, where electric power loss at a voltage transfer or in electric power transmission is low and there is no need to make the cable thick, has been studied as a measure for preventing global warming. In particular, in an information device such as a server, since a large amount of electric power is consumed, it is desirable to have such an electric power system.

With respect to the electric power supplied to the electronic device, if the voltage is high, a human body may be influenced or operations of electric components may be adversely affected.

In a case where the electric power having a high voltage is used for the information device such as the server, arrangement or maintenance of the device may be performed manually, so that it is necessary to make the connector device at a portion where the electric connection is made different from one used for a normal alternating current commercial power supply.

SUMMARY OF THE INVENTION

Accordingly, embodiments of the present invention may provide a novel and useful connector device, receiving connector, and inserting connector solving one or more of the problems discussed above.

More specifically, the embodiments of the present invention may provide a connector device, a receiving connector, and an inserting connector whereby electric power having a high voltage can be safely supplied.

Another aspect of the embodiments of the present invention may be to provide a connector device configured to electrically connect an electric power source and an electronic device which receives a supply of electric power from the electric power source, the connector device including:

an inserting connector and a receiving connector, wherein the receiving connector is connected to the electronic device;

the receiving connector includes a single control plug terminal and two electric power jack terminals made of a conductor material, the electric power jack terminals being configured to receive the supply of the electric power;

the control plug terminal can be extended and retracted in an inserting direction of the receiving connector;

the inserting connector is connected to the electric power source;

the inserting connector includes a control jack terminal corresponding to the control plug terminal and two electric power plug terminals corresponding to the two electric power jack terminals;

the control jack terminal includes a control switch; and in a state where the two electric power plug terminals and the two electric power jack terminals are engaged with each other, by extending the control plug terminal to the control jack terminal in the inserting direction, a contact of the control switch is connected so that the electric power is supplied to the electronic device.

Another aspect of the embodiments of the present invention may be to provide a receiving connector configured to be connected to an inserting connector, the inserting connector being configured to electrically connect an electric power source and an electronic device receiving a supply of electric power from the electric power source, the receiving connector being connected to the electronic device, the receiving connector including:

a control plug terminal; and two electric power jack terminals made of a conductor material, the electric power jack terminals being configured to receive the supply of the electric power, wherein the control plug terminal can be extended and retracted in an inserting direction of the receiving connector;

the inserting connector is connected to the electronic device;

the inserting connector includes a control jack terminal corresponding to the control plug terminal and two electric power plug terminals corresponding to the two electric power jack terminals;

the control jack terminal includes a control switch; and when the two electric power plug terminals and the two electric power jack terminals are engaged with each other, by extending the control plug terminal to the control jack terminal in the inserting direction, a contact of the control switch is connected so that the electric power is supplied to the electronic device.

Another aspect of the embodiments of the present invention may be to provide an inserting connector configured to be connected to a receiving connector, the receiving connector being configured to electrically connect an electric power source and an electronic device receiving a supply of electric power from the electric power source, the inserting connector being connected to the electronic power source, the inserting connector including:

a control jack terminal corresponding to a control plug terminal of the receiving connector; and two electric power plug terminals corresponding to two electric power jack terminals of the receiving connector, the electric power jack terminals being made of a conductor material and configured to receive the supply of the electric power, wherein the control plug terminal can be extended and retracted in an inserting direction of the receiving connector;

the receiving connector is connected to the electronic device;

the control jack terminal includes a control switch; and in a state where the two electric power plug terminals and the two electric power jack terminals are engaged with each other, respectively, by extending the control plug terminal to the control jack terminal in the inserting direction, a contact of the control switch is connected so that the electric power is supplied to the electronic device.

Additional objects and advantages of the embodiments are set forth in part in the description which follows, and in part will become obvious from the description, or may be learned by practice of the invention. The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

A description is given below, with reference to the FIG. 1 through FIG. 20 of embodiments of the present invention.

First Embodiment

A connector device, a receiving connector and an inserting connector of a first embodiment of the present invention are discussed.

(Structures of the Connector Device, the Receiving Connector and the Inserting Connector)

Figure 1:
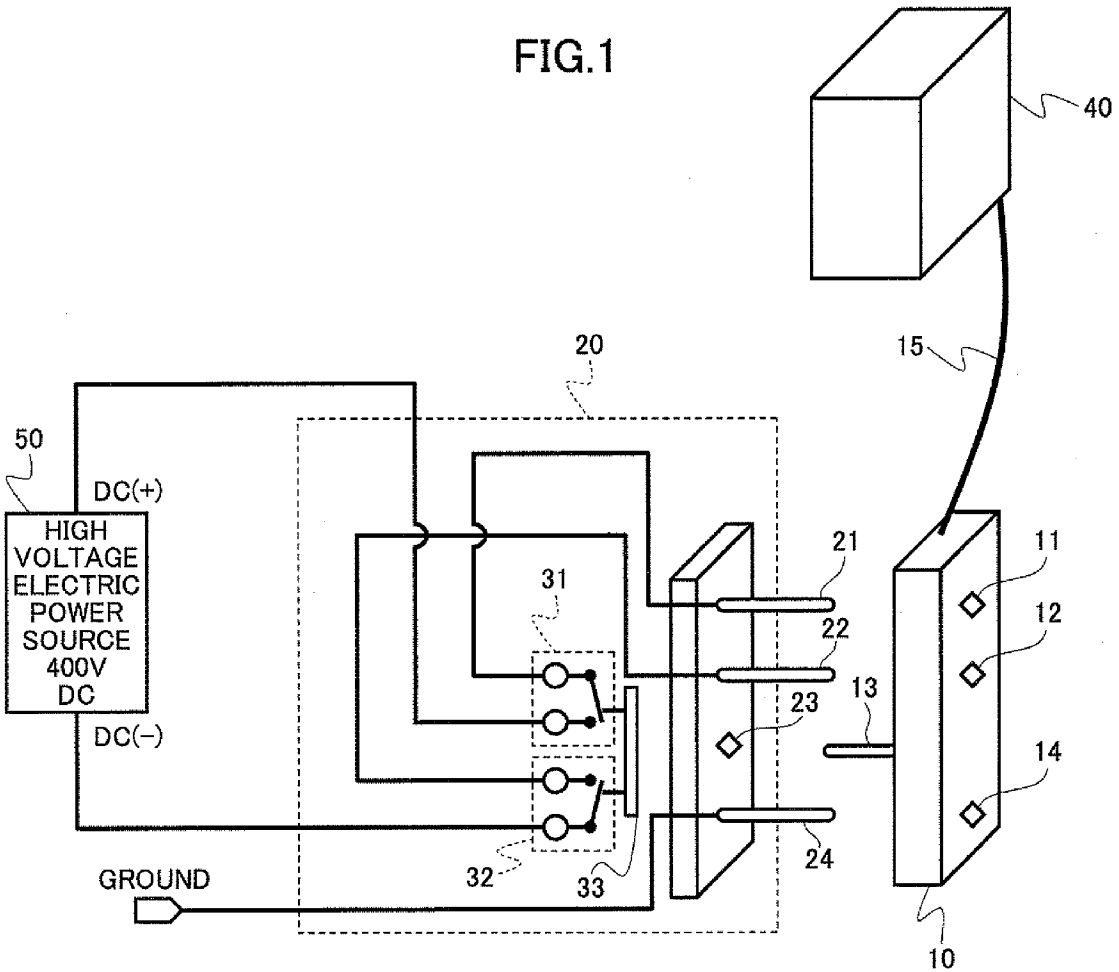
FIG. 1 is a structural view of a connector device of a first embodiment of the present invention.

FIG. 1 is a schematic view of structures of the connector device, the receiving connector and the inserting connector of the first embodiment of the present invention.

The connector device of the first embodiment of the present invention includes a receiving connector 10 and an inserting connector 20.

The receiving connector 10 is connected to an information device 40 such as a server. The receiving connector 10 includes two electric power jack terminals 11 and 12 configured to receive a supply of the electric power, a control plug terminal 13, and a ground jack terminal 14. The control plug terminal 13 can be extended and retracted in an inserting direction of the receiving connector 10.

On the other hand, the inserting connector 20 is connected to a high voltage electric power source 50 configured to supply the electric power. The inserting connector 20 includes electric power plug terminals 21 and 22, a control jack terminal 23, and a ground plug terminal 24. The electric power plug terminals 21 and 22 correspond to the electric power jack terminals 11 and 12. The control jack terminal 23 corresponds to the control plug terminal 13. The ground plug terminal 24 corresponds to the ground jack terminal 14.

Two control switches 31 and 32 are provided in the inserting connector 20. The control switches 31 and 32 are formed of, for example, plate spring switches. By pushing the control switches 31 and 32, contacts are made (closed) so that electric current flows. In this embodiment, a plate spring 33 which is an insulator is provided right above the control switches 31 and 32.

One terminal of the control switch 31 is connected to a positive output of the high voltage electric power source 50 and another terminal of the control switch 31 is connected to the electric power plug terminal 21. In addition, one terminal of the control switch 32 is connected to a negative output of the high voltage electric power source 50 and another terminal of the control switch 32 is connected to the electric power plug terminal 22.

In an engaging state where the receiving connector 10 and the inserting connector 20 are engaged with each other, by extending the control plug terminal 13 of the receiving connector 10, contacts of the two control switches 31 and 31 are connected (closed) via a force applied by the plate spring 33 which is an insulator.

Thus, by closing the contacts of the control switches 31 and 32, electric power is supplied to the electric power plug terminals 21 and 22 of the inserting connector 20. In addition, the electric power is supplied to the information device 40 such as the server via the electric power jack terminals 11 and 12 of the receiving connector 10.

In the connector device of the first embodiment of the present invention, the control switches 31 and 32 are connected to the electric power plug terminals 21 and 22. This is because in a case of direct current electric power having a voltage greater than 48 V, especially a high voltage equal to or greater than 200 V, the likelihood of danger to the human body due to contact may be extremely high. Accordingly, by connecting the control switches 31 and 32 to the electric power plug terminals 21 and 22, the electric power supply from both the electric power plug terminals 21 and 22 is controlled so that safety properties can be improved.

Here, it should be noted that, in the embodiments of the present invention, the control jack terminal 23 includes a terminal having a structure where a control switch mentioned below is provided inside the terminal. That is, by the control switch, turning-on and turning-off are controlled by a dynamic force based on extension and retraction of the control plug terminal 13.

(Structure of the Connector Device)

Next, details of the structure of the connector device of the first embodiment of the present invention are discussed with reference to FIG. 2 through FIG. 4.

Figure 2:
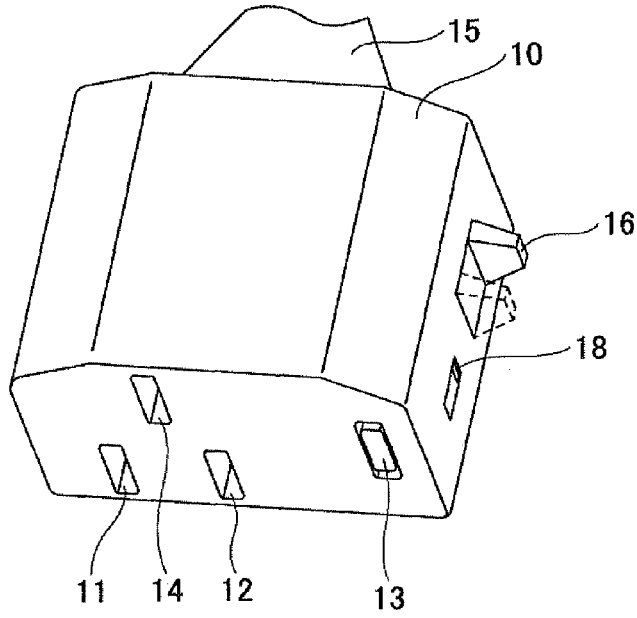
FIG. 2 is a perspective view of a receiving connector of the first embodiment of the present invention.
Figure 2:
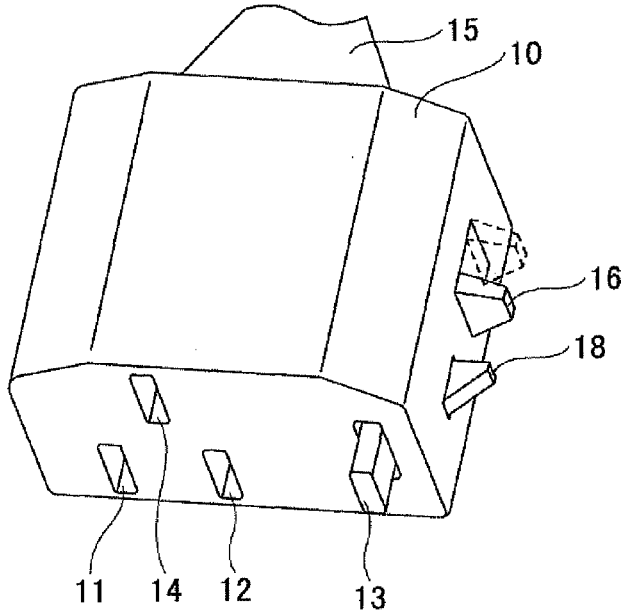

FIG. 2(*a*) is a perspective view of the receiving connector 10 of the first embodiment of the present invention in a retracted state where the control plug terminal 13 is retracted. FIG. 2(*a*) is a perspective view of the receiving connector 10 of the first embodiment of the present invention in an extended state where the control plug terminal 13 is extended.

Figure 3:
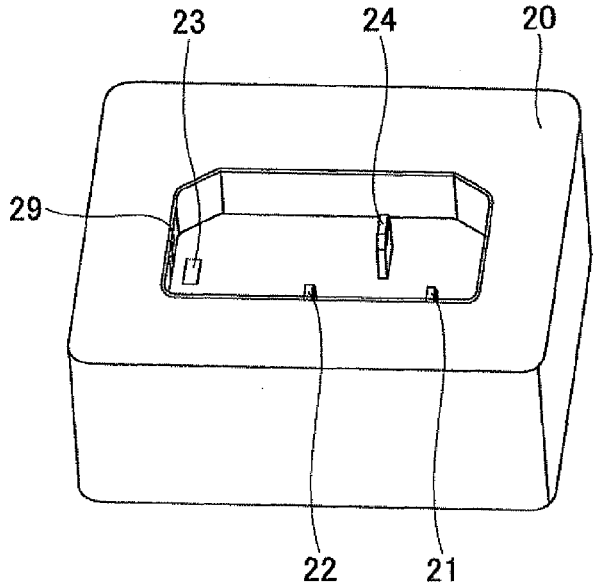
FIG. 3 is a structural view of an inserting connector of the first embodiment of the present invention.
Figure 3:
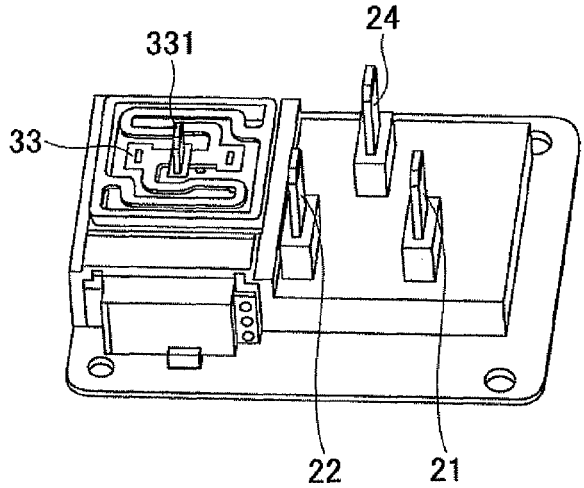

FIG. 3(*a*) is a perspective view of the inserting connector 20 of the first embodiment of the present invention. FIG. 3(*b*) is a perspective view showing an internal structure of the inserting connector 20 of the first embodiment of the present invention.

Figure 4:
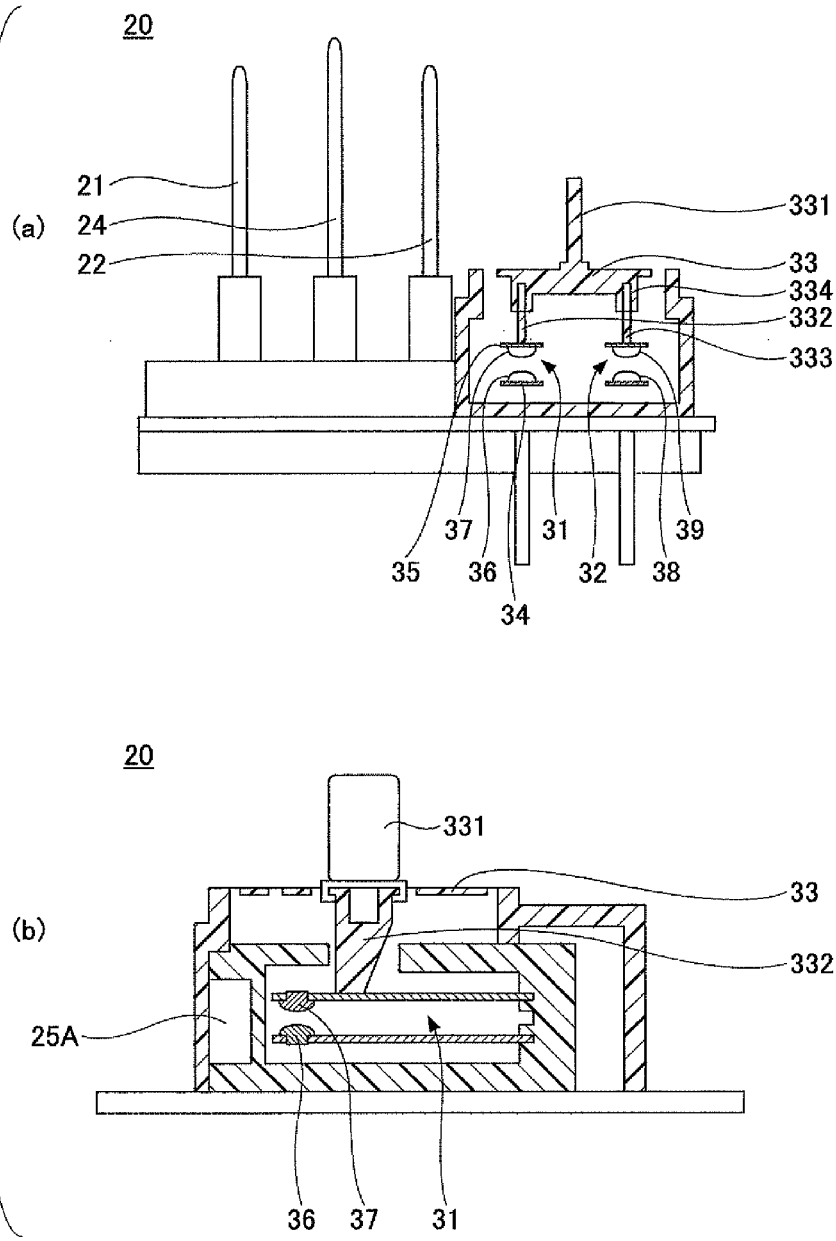
FIG. 4 is an internal structural view of the inserting connector of the first embodiment of the present invention.

FIG. 4(*a*) is a partial cross-sectional view of the internal structure of the inserting connector 20 seen from a front surface. FIG. 4(*b*) is a partial cross-sectional view of the internal structure of the inserting connector 20 seen from a side surface.

As shown in FIG. 2(*a*), an electric power cable 15 for 400 VDC (voltage direct current) is connected to the receiving connector 10 of the first embodiment of the present invention. The electric power jack terminals 11 and 12, the control plug terminal 13, and the ground jack terminal 14 made of metal are provided at a side of the receiving connector 10 opposite to a side where the electric power cable 15 is connected.

Just after the inserting connector 20 is inserted in the receiving connector 10, the control plug terminal 13 is in the retracted state shown in FIG. 2(*a*). After this, by sliding the slide switch 16 in a direction where the control plug terminal 13 is inserted, the control plug terminal 13 is extended and a lock terminal 18 projects in a direction perpendicular to the inserting direction of the control plug terminal 13 so that the extended state shown in FIG. 3(*b*) is formed.

On the other hand, as shown in FIG. 3(*a*), a part of a main body of the receiving connector 10 is engaged in the inserting connector 20 of the first embodiment of the present invention.

The inserting connector 20 includes the electric power plug terminals 21 and 22, the control jack terminal 23, the ground plug terminal 24, and a concave part 29. The electric power plug terminals 21 and 22 are connected to the electric power jack terminals 11 and 12. The control jack terminal 23 is connected to the control plug terminal 13 in the extended state where the control plug terminal 13 is extended. The ground plug terminal 24 is connected to the ground jack terminal 14. The concave part 29 has a configuration corresponding to the projecting lock terminal 18.

FIG. 3(*b*) and FIG. 4 are internal structural views of the inserting connector 20. The two control switches 31 and 32 are provided inside the control jack terminal 23 of the inserting connector 20. The plate spring 33 which is an insulator and provided above the control switches 31 and 32 is pushed from the upper part by the extended control plug terminal 13 so as to be deformed and thereby the two control switches 31 and 32 are closed and the electric current flows.

Since the flowing electric current is 400 VDC (voltage direct current), it would be dangerous for the head end of the control plug terminal 13 of the receiving connector 10 to directly push the control switches 31 and 32 so that the contacts are closed (contacts of a switch are in contact). Therefore, in this embodiment, contacts of each of the control switches 31 and 32 are made to be in contact due to a force from the plate spring 33 which is an insulator in this embodiment. In the first embodiment of the present invention, permanent magnets 25A and 25B configured to prevent generation of arcs are provided in the vicinities of the contacts of the control switches 31 and 32.

(Connecting Method of the Connector Device)

Next, a connecting method of the receiving connector 10 and the inserting connector 20 of the first embodiment of the present invention is discussed with reference to FIG. 5 through FIG. 10.

Figure 5:
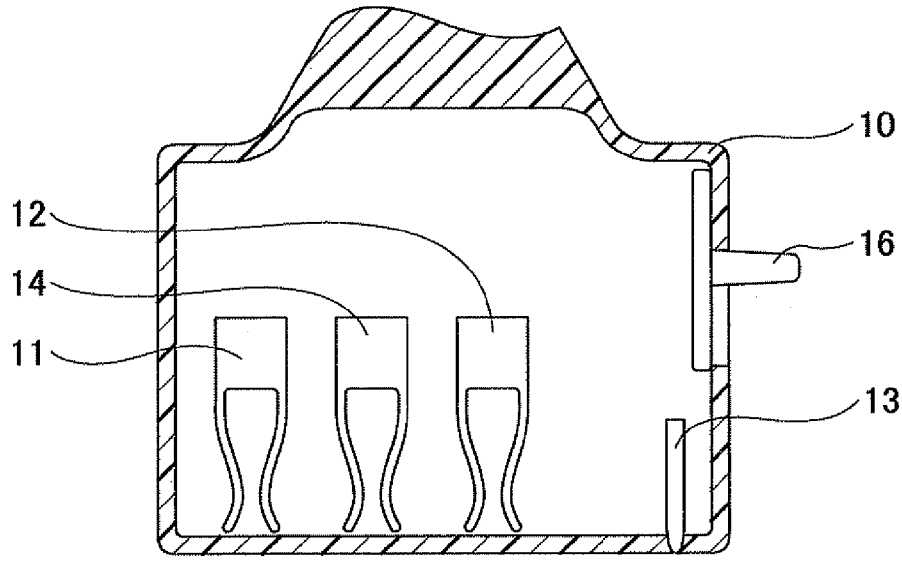
FIG. 5 is a first view for explaining a connecting method of the connector device of the first embodiment of the present invention.
Figure 5:
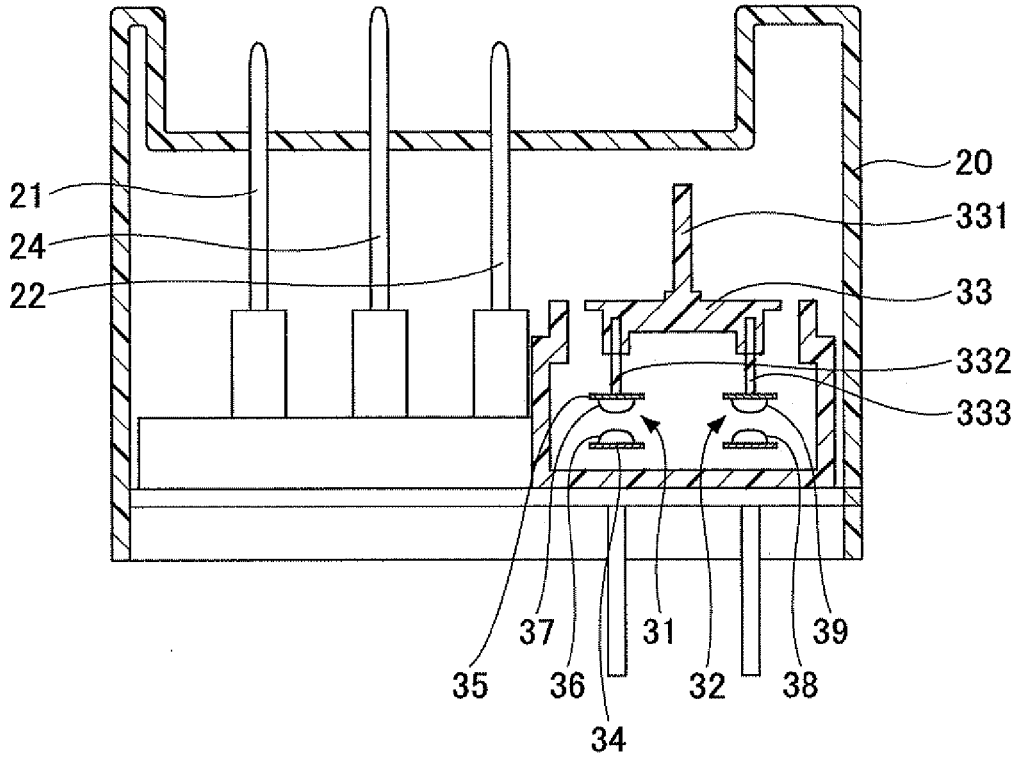
Figure 6:
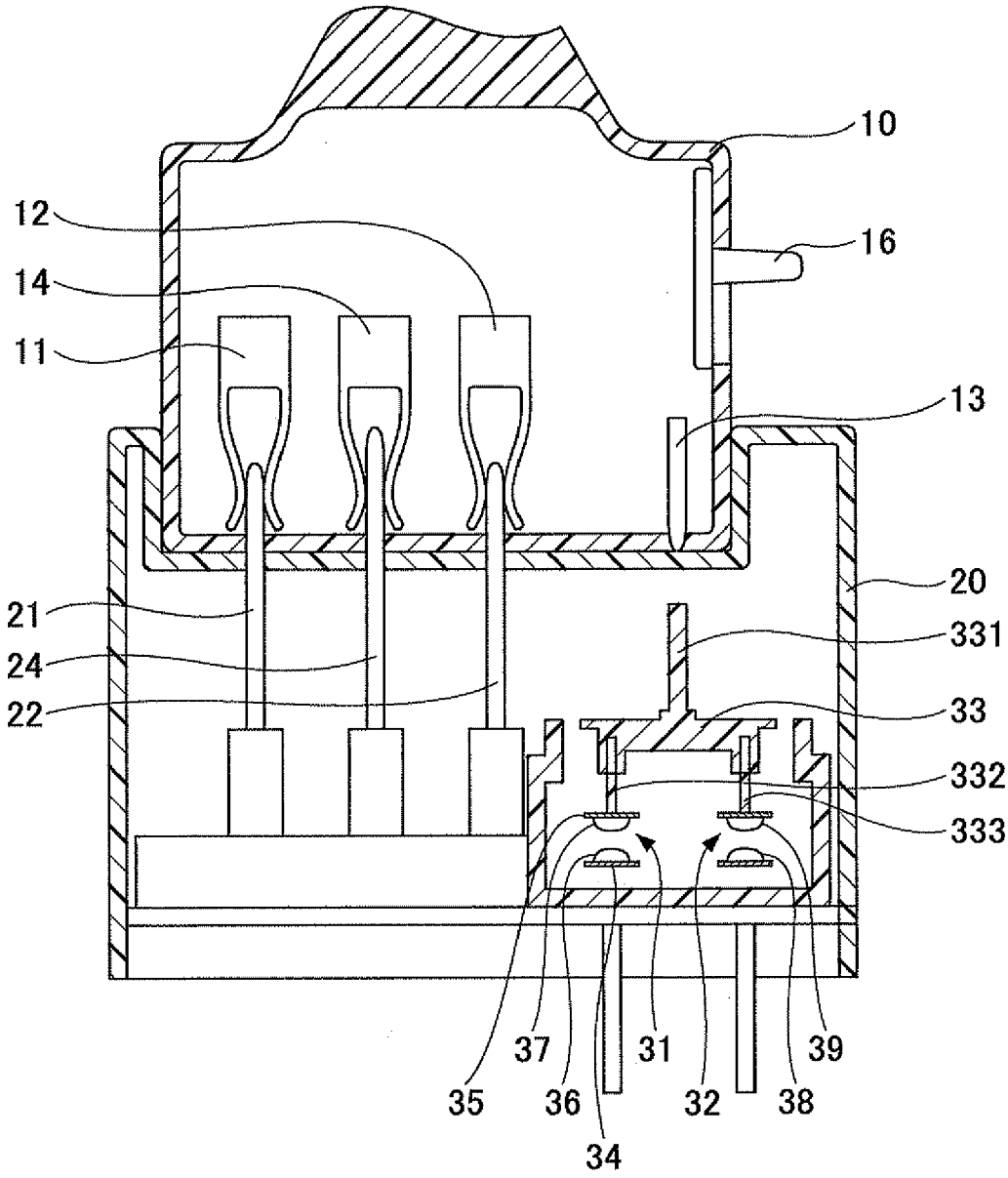
FIG. 6 is a second view for explaining the connecting method of the connector device of the first embodiment of the present invention.
Figure 7:
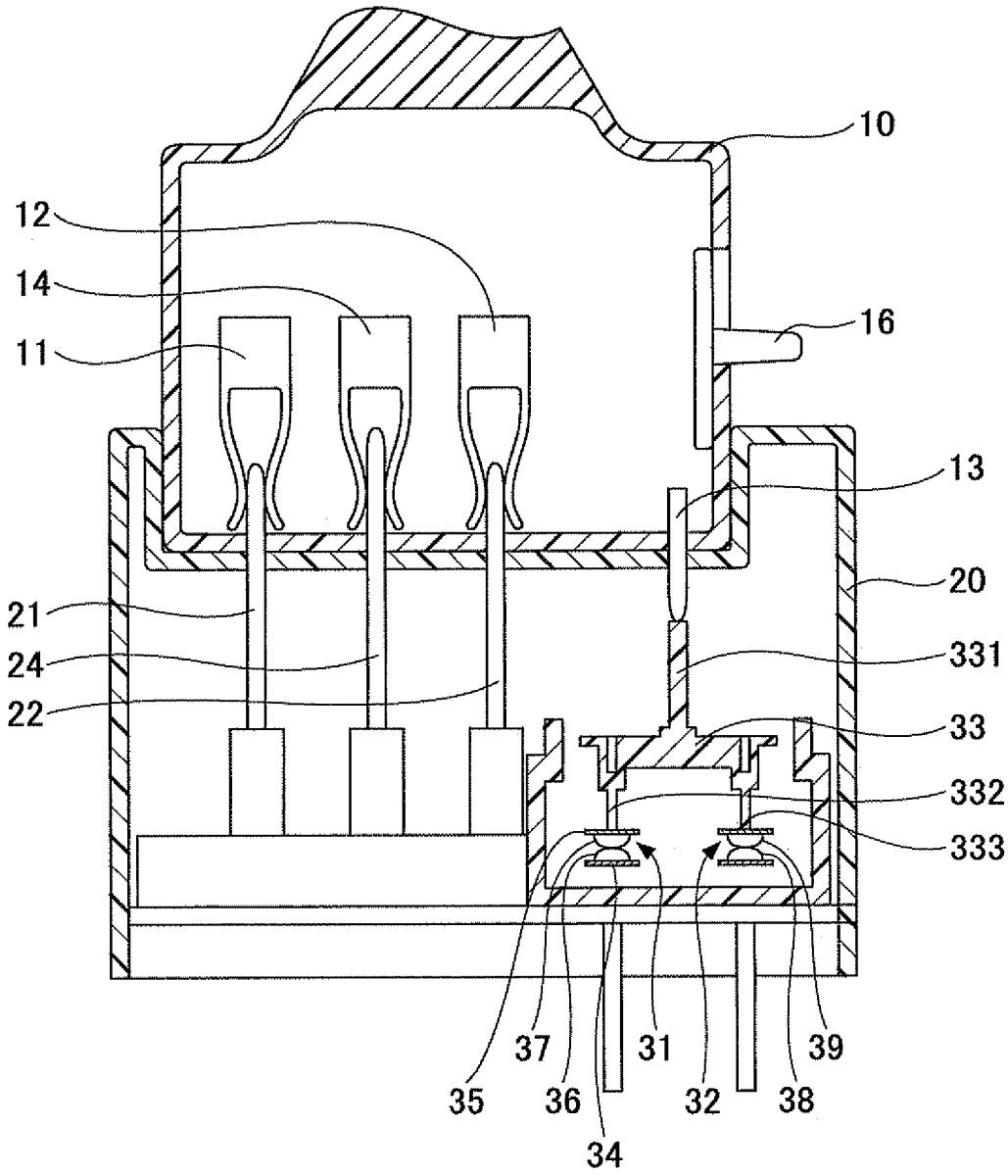
FIG. 7 is a third view for explaining the connecting method of the connector device of the first embodiment of the present invention.

FIG. 5 through FIG. 7 are views for explaining the connecting method of the receiving connector 10 and the inserting connector 20 and show schematic structures seen from a front side.

Figure 8:
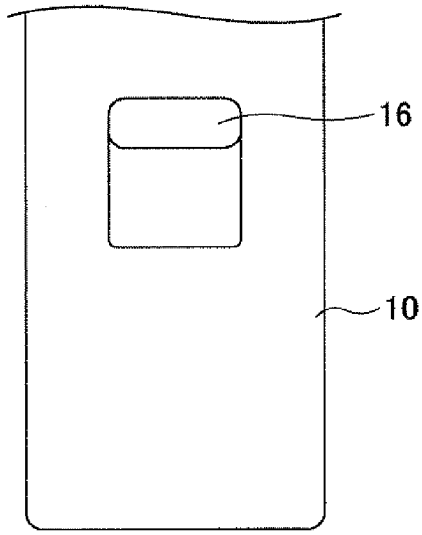
FIG. 8 is a fourth view for explaining the connecting method of the connector device of the first embodiment of the present invention.
Figure 8:
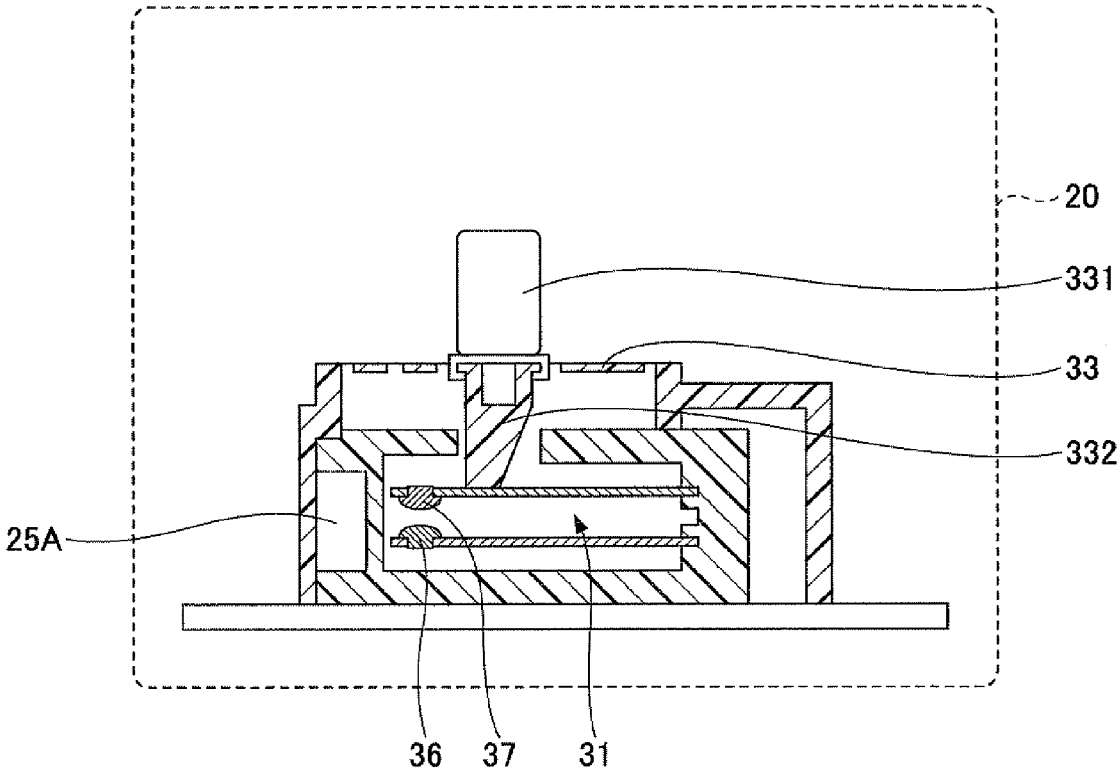
Figure 9:
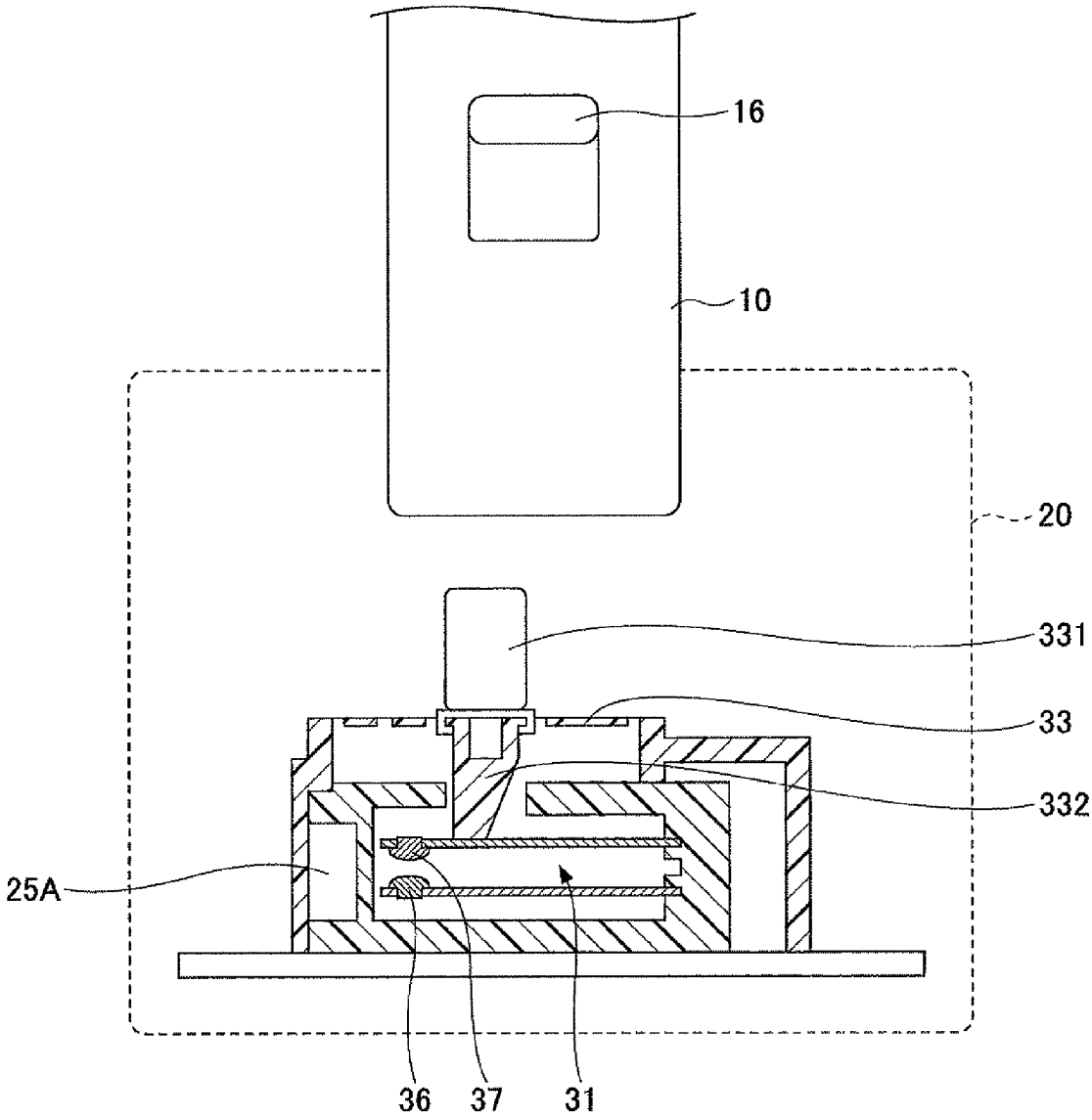
FIG. 9 is a fifth view for explaining the connecting method of the connector device of the first embodiment of the present invention.
Figure 10:
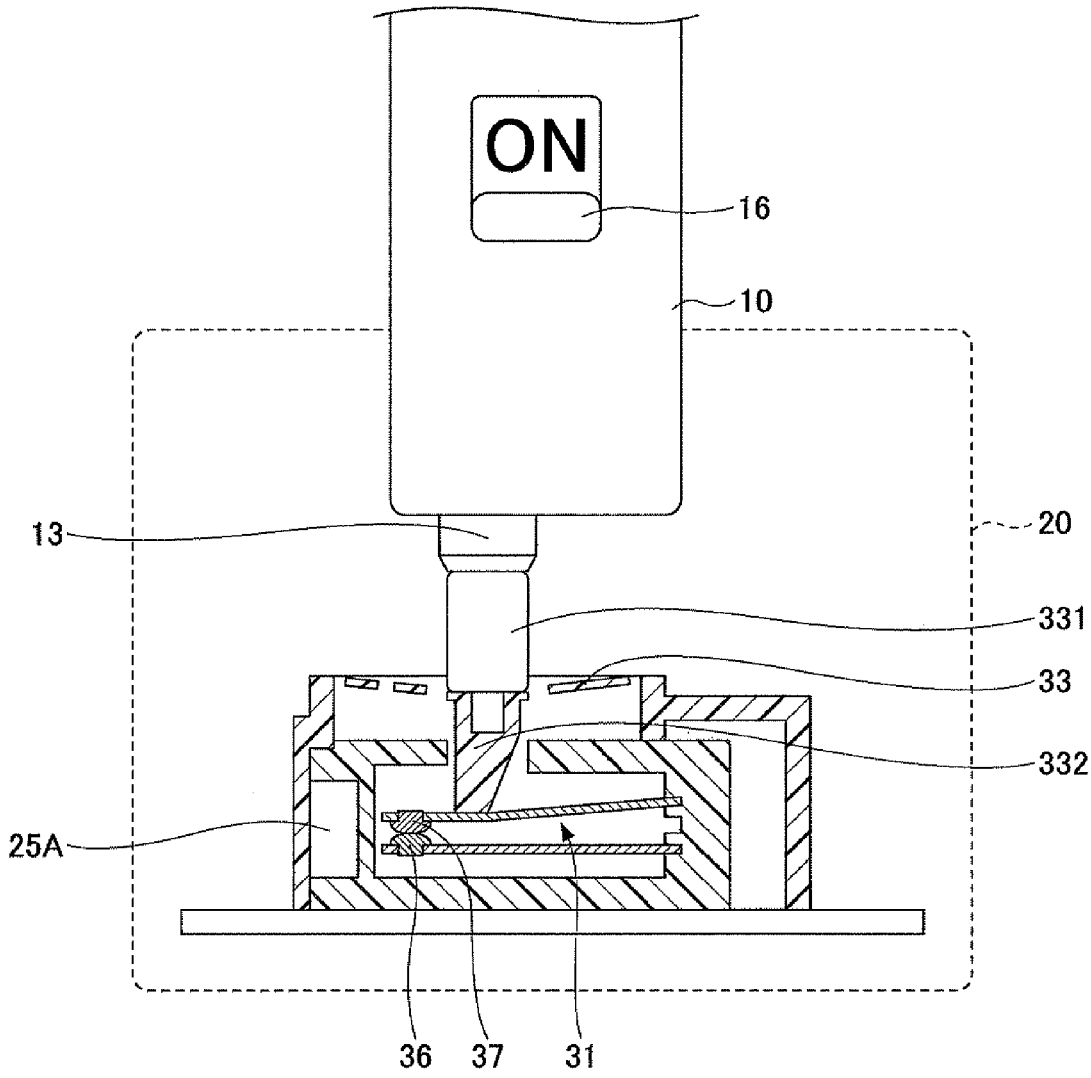
FIG. 10 is a sixth view for explaining the connecting method of the connector device of the first embodiment of the present invention.

FIG. 8 through FIG. 10 are views for explaining the connecting method of the receiving connector 10 and the inserting connector 20 and show schematic structures seen from a side view. In FIG. 8 through FIG. 10, for the convenience for understanding, the electric power jack terminals 11 and 12 and the ground jack terminal 14 are omitted.

The receiving connector 10 and the inserting connector 20 are shown before being connected to each other in FIG. 5 and FIG. 8; the electric power jack terminal 11 of the receiving connector 10 and the electric power plug terminal 21 are not connected to each other. Similarly, the electric power jack terminal 12 shown in FIG. 1 and the electric power plug terminal 22 are not connected to each other. The ground jack terminal 14 and the ground plug terminal 24 are not connected to each other. In addition, the control plug terminal 13 is retracted. This retracted state exists before the slide switch 16 configured to extend or retract the control plug terminal 13 is moved in the inserting direction (downward).

On the other hand, in the inserting connector 20, the control switch 31 and the electric power plug terminal 21 are connected to each other. More specifically, the control switch 31 includes a plate spring part 35 and contacts 36 and 37. The contact 36 is connected to the electric power plug terminal 21. The plate spring part 35 is formed of a metal plate spring. The contact 37 is connected to the electric power source 50 via the plate spring part 35.

Similarly, the control switch 32 is connected to the electric power plug terminal 22. The control switch 32 is connected to the electric power source 50. In addition, the plate spring 33 which is an insulator provided above the control switches 31 and 32 is deformed by applying a force from an upper part of the plate spring 33 so that the force is transmitted to the control switches 31 and 32. The plate spring 33 includes a projecting part 331 projecting in a direction parallel with the inserting direction.

Next, the engaging state where the inserting connector 20 is inserted in the receiving connector 10 is shown in FIG. 6 and FIG. 9.

In this engaging state, the electric power plug terminal 21 and the electric power jack terminal 11 of the receiving connector 10 are engaged with each other. Similarly, the electric power jack terminal 12 and the electric power plug terminal 22 are engaged with each other. The ground jack terminal 14 and the ground plug terminal 24 are engaged with each other.

In this engaging state, the control plug terminal 13 remains retracted until the slide switch 16, configured to extend or retract the control plug terminal 13, is moved in the inserting direction (downward). Therefore, the contact 37 and the contact 36 of the control switch 31 of the receiving connector 20 are not yet connected (in contact with) to each other. Similarly, a contact 39 and a contact 38 of the control switch 32 are not yet connected to each other.

Next, the engaging state where the inserting connector 20 is inserted in the receiving connector 10 and the extended state where the control plug terminal 13 is extended are shown in FIG. 7 and FIG. 10.

More specifically, by moving the slide switch 16 in the inserting direction (downward), the control plug terminal 13 is extended so that the head end of the control plug terminal 13 pushes the projecting part 331 of the plate spring 33 which is an insulator so that the plate spring 33 is bent and deformed. Based on deformation of the plate spring 33 which is an insulator, the plate spring part 35 of the control switch 31 is bent so that the contact 37 and the contact 36 of the control switch 31 are connected to each other and the contact 38 and the contact 39 of the control switch 32 are connected to each other.

When the contact 37 and the contact 36 of the control switch 31 and the contact 38 and the contact 39 of the control switch 32 are connected to each other, electric power from the electric power source 50 shown in FIG. 1 is supplied to the electric power plug terminal 21 and electric power plug terminal 22 shown in FIG. 1.

As a result of this, the electric power from the electric power source 50 is supplied to the electronic device 40, such as a server, shown in FIG. 1 and connected to the receiving connector 10, via the electric power jack terminals 11 and 12 connected to the electric power plug terminals 21 and 22.

In order to remove the inserting connector 20 from the receiving connector 10, first, the slide switch 16 is moved in a pulling-out direction (upward). As a result of this, the control plug terminal 13 is retracted and the plate spring 33 is elastically restored. Because of this, the plate spring part 35 of the control switch 31 is elastically restored so that the connection between the contact 37 and the contact 36 of the control switch 31 is broken. Similarly, the connection between the contact 39 and the contact 38 of the control switch 32 is broken.

At this moment, arcing electric current may be generated between the contacts 36 and 37 and between the contacts 38 and 39. If the arcing electric current is generated, an excessive current may be applied to the electronic device connected to the receiving connector 10. Hence, it may be dangerous for the electric power to be resupplied to the electronic device after that. Especially, it may be dangerous that the direct current electric power having a high voltage greater than 48 V, even more so a voltage equal to or greater than 200 V, be resupplied to the electronic device after that.

On the other hand, in the plate spring 33 of the first embodiment of the present invention, contact parts 332 and 333 contacting the control switches 31 and 32 are made molten due to heat of the arcing electric current. More specifically, the plate spring 33 may be molded of thermoplastic resin such as PBT (polybutylene terephthalate) resin or PC (polycarbonate) resin. In addition, the contact parts 332 and 333 project from a main body part 334 (see FIG. 4) of the plate spring 33 which may cause these contact parts 332 and 333 to be easily melted.

When the contact parts 332 and 333 of the plate spring 33 are melted, even if the control plug terminal 13 is extended, the contacts 36 and 37 do not come in contact with each other and the contacts 38 and 39 do not come in contact with each other. As a result of this, it is possible to prevent resupply of the electric power after the arcing is generated.

The melting point of the plate spring 33 is, from the perspective of easiness of melting of the contact parts 332 and 333, preferably equal to or less than 250 more preferably equal to or less than 180° C. The melting point of the plate spring 33 is, from the perspective of durability or reliability, preferably equal to or less than 150° C.

Next, the contacts 36 and 37 of the control switch 31 and the contacts 38 and 39 of the control switch 32 are discussed with reference to FIG. 11.

As shown in FIG. 4, the permanent magnet 25A is provided in the vicinities of the contacts 36 and 37 of the control switch 31. Similarly, the permanent magnet 25B is provided in the vicinities of the contacts 38 and 39 of the control switch 32.

Figure 11:
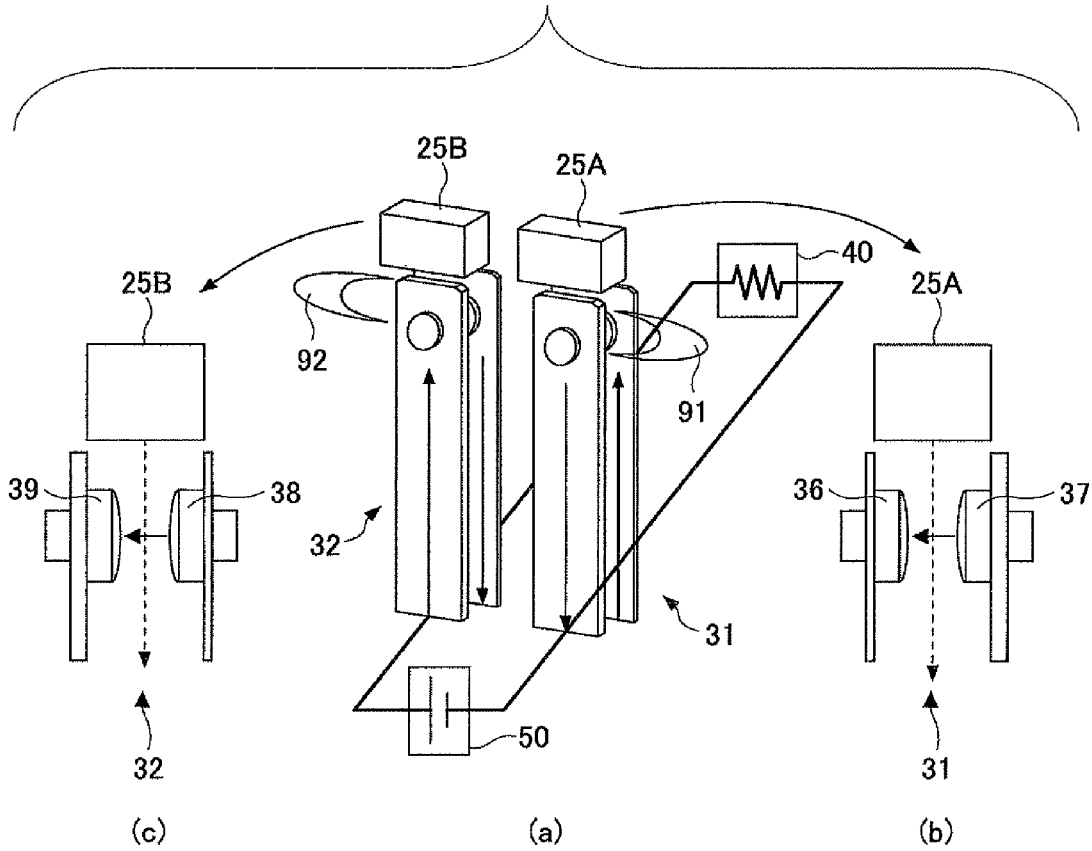
FIG. 11 is a schematic structural view of a switch part of the inserting connector of the first embodiment of the present invention.
Figure 11:
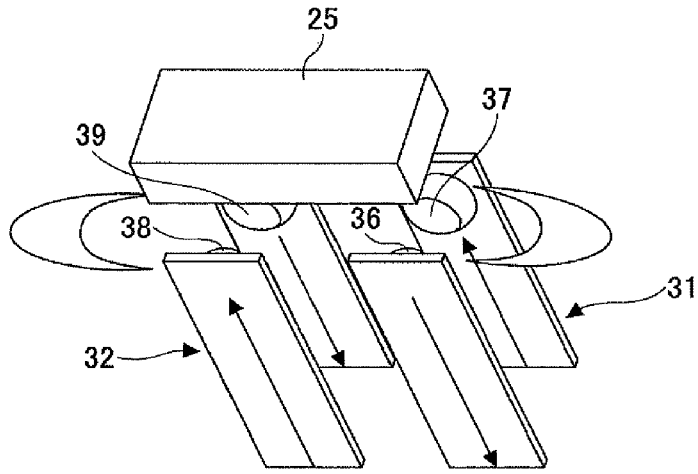

A straight line arrow at the control switch 31 shown in FIG. 11(*a*) indicates a direction of the electric current flowing when the contacts 36 and 37 are connected. A straight line arrow at the control switch 32 shown in FIG. 11(*a*) indicates a direction of the electric current flowing when the contacts 38 and 39 are connected.

In this connected state, the electric current supplied from the electric power source 50 flows into the control switches 31 and 32 so as to be supplied to the information device 40 such as the server. Here, when the control plug terminal 13 is retracted, the contacts 36 and 37 of the control switch 31 are separated from each other and the contacts 38 and 39 of the control switch 32 are separated from each other, so that the electric current does not flow. At this moment, arcing electric current may be generated between the contacts 36 and 37 and between the contacts 38 and 39.

On the other hand, by providing the permanent magnet 25A in the vicinities of the contacts 36 and 37, magnetic flux is generated as shown by a dotted line in FIG. 11(*b*). Hence, a Lorentz force acts based on Fleming's left hand rule so that the arc is deflected as shown by a numerical reference 91 in FIG. 11(*a*) and is eliminated.

In addition, by providing the permanent magnet 259 in the vicinities of the contacts 38 and 39, magnetic flux is generated as shown by a dotted line in FIG. 11(*c*). Hence, a Lorentz force acts based on Fleming's left hand rule so that the arc is deflected as shown by a numerical reference 92 in FIG. 11(*a*) and the arc is eliminated.

As a result of this, the supply of the electric power is immediately cut. Hence, it is possible to achieve safety properties.

Although a case where two permanent magnets 25A and 25B are used is discussed in the above-mentioned example, a single permanent magnet 25 formed by the permanent magnets 25A and 25B in a body may be used as shown in FIG. 11(*d*).

Next, functions of the lock terminal 18 are discussed with reference to FIG. 12.

Figure 12:
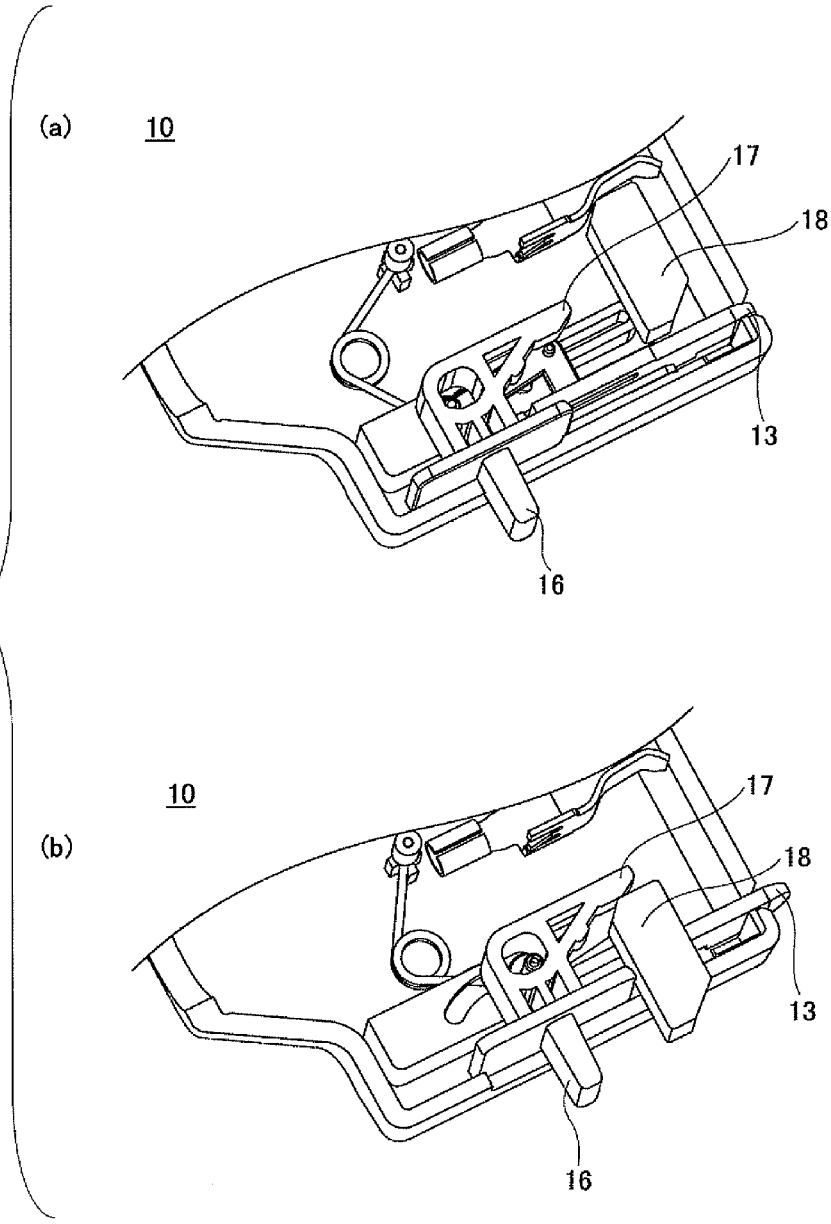
FIG. 12 is an internal structural view of the receiving connector of the first embodiment of the present invention.

Here, FIG. 12(*a*) is a perspective view of an internal structure of the receiving connector 10 of this embodiment in the retracted state where the control plug terminal 13 is retracted. FIG. 12(*b*) is a perspective view of an internal structure of the receiving connector 10 of this embodiment in the extended state where the control plug terminal 13 is extended.

Just after the inserting connector 20 is inserted into the receiving connector 10, the control plug 13 is in the retracted state shown in FIG. 12(*a*).

After this, by sliding the slide switch 16 in a direction where the control plug terminal 13 is inserted, the control plug terminal 13 is extended and an inclination part 17 of the slide switch 16 pushes the lock terminal 18. As a result of this, the lock terminal 18 projects in a direction perpendicular to the inserting direction of the control plug terminal 13 so that the extended state shown in FIG. 12(*b*) is formed.

The concave part 29 (see FIG. 3) having a configuration corresponding to the projecting lock terminal 18 is formed in the receiving connector 20. In the extended state where the lock terminal 18 projects, engagement of the receiving connector 10 and the inserting connector 20 is not broken due to the concave part 29. Hence, it is possible to prevent the inserting connector 20 from unintentionally being pulled out from the receiving connector 10 and thereby safety properties can be improved.

As discussed above, in the first embodiment of the present invention, by using the slide switch 16, the control plug terminal 13 is extended or retracted in the inserting direction and the lock terminal 18 projects. However, by using a push button, which can be moved in a direction perpendicular to the inserting direction, instead of the slide switch 16, the control plug terminal 13 may be extended or retracted in the inserting direction and the lock terminal 18 may project.

Thus, in the connector device of the first embodiment of the present invention, in the engaging state where the electric power jack terminals 11 and 12 of the receiving connector 10 are engaged with the electric power plug terminals 21 and 22 of the inserting connector 20, by pushing the control plug terminal 13, the electric current flows via the control switches 31 and 32 provided at the control jack terminal 22. As a result of this, the electric power is supplied to the information device 40 via the electric power plug terminals 21 and 22 and the jack terminals 11 and 12 of the receiving connector 10.

Thus, the electric power is supplied from the electric power plug terminals 21 and 22 only in the extended state where the control plug terminal 13 is extended, so that it is possible to prevent the high voltage of 400 VDC from being applied to the electric power plug terminals 21 and 22 when the inserting connector 20 is not connected to the receiving connector 10.

In other words, when the inserting connector 20 is not connected to the receiving connector 10, if the high voltage of 400 VDC is applied to the electric power plug terminals 21 and 22 of the inserting connector 20, a human body may be in danger when the body contacts the electric power plug terminals 21 and 22 in error or via a driver, a metal piece, or a cut conductive line. Such a problem can be prevented according to the structure of the first embodiment of the present invention.

(Electric Power Supply System)

Next, a structure of an electric power supply system using the connector device of the first embodiment of the present invention is discussed.

Figure 13:
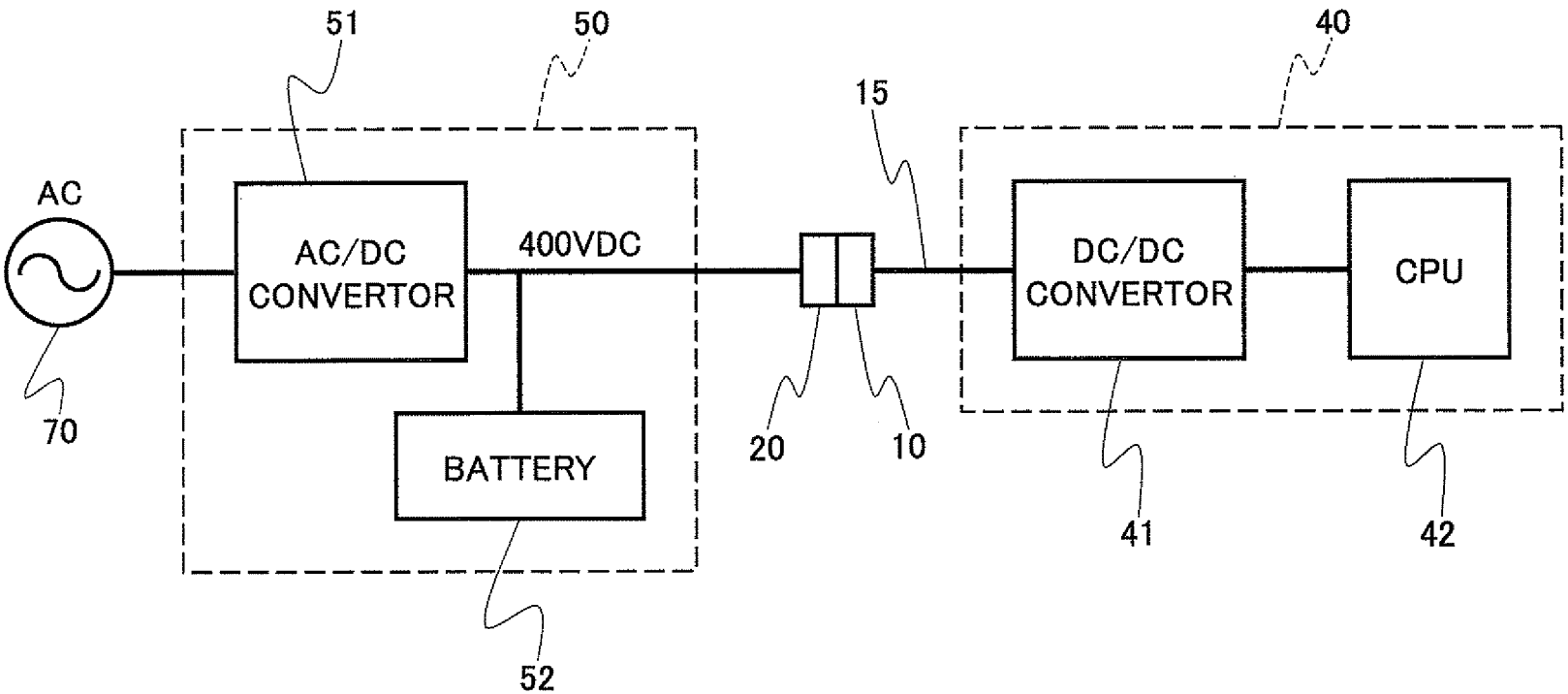
FIG. 13 is a structural view of an electric power supply system using the connector device of the first embodiment of the present invention.

FIG. 13 shows a structure of the electric power supply system using the connector device of the first embodiment of the present invention.

In this electric power supply system, electric power of AC100V or AC200V supplied from a commercial power supply 70 is input to the high voltage electric power source 50, and the AC100V or AC200V is converted to DC400V by an AC/DC convertor 51 of the high voltage electric power source 50.

Since the direct current electric power can be stored in a battery or the like, it is possible to easily correspond in a case of blackout or the like by providing a battery 52 for back-up. The inserting connector 20 is connected to the high voltage electric power source 50 via the electric power source cable in this embodiment. The electric power of 400 VDC from the high voltage electric power source 50 is supplied from the inserting connector 20.

On the other hand, the receiving connector 10 of the first embodiment of the present invention is connected to the information device 40 such as the server via the electric power source cable 15. Hence, by electrically connecting the inserting connector 20 and the receiving connector 10, the electric power is supplied from the high voltage electric power source 50 to the information device 40 such as the server.

In addition, a DC/DC converter 41 is provided inside the information device 40 such as the server. The DC/DC converter 41 is configured to convert 400 VDC to a DC output having a low voltage whereby an electronic component such as a CPU 42 can be operated.

The above-discussed electric power supply system has, for example, the following advantages. Since conversion from AC from the commercial power supply 70 to DC is required only one time, loss of the electric power is small. In addition, it is not necessary to consider the thickness of the conductive line and other factors in a case of the 400 VDC which is a high voltage direct electric current. Furthermore, the direct current electrical energy can be stored in the battery 52 and it is possible to easily correspond to a case of stopping of the supply of the electric power from the commercial power supply 70 due to blackout or the like.

Figure 14:
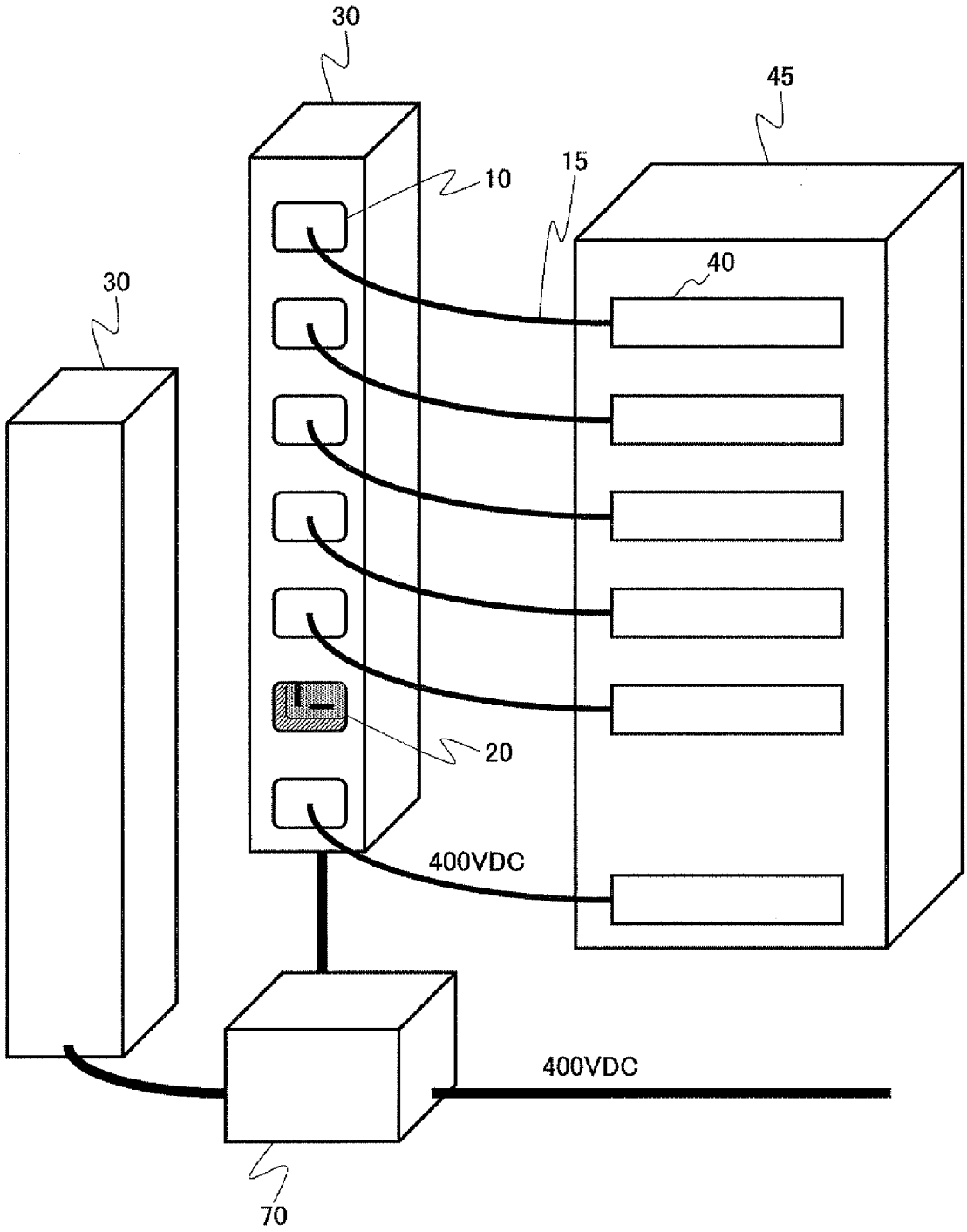
FIG. 14 is a perspective view of a PDD using the connector device of the first embodiment of the present invention.

Next, a PDU (Power Distribution Unit) using a connector device of the first embodiment of the present invention is discussed with reference to FIG. 14.

The 400 VDC supplied from the high voltage electric power source 50 shown in FIG. 13 is input to a distribution board 70 so that the electric power is distributed to each of the PDUs 30. Plural input connectors 20 of the first embodiment of the present invention are provided in each of the PDUs 30. Electric power of 400 VDC can be supplied via each of the inserting connectors 20.

On the other hand, plural information devices 40 such as the servers are installed in the server rack 45. The receiving connectors 10 configured to receive the supply of electric power are connected to, via the electric power source cables 15, the respective information devices 40 such as the servers. By electrically connecting the receiving connectors 10 and the inserting connectors 20 provided in the PDUs 30 to each other, the electric power of 400 VDC can be supplied.

In the above-discussed example, 400 VDC is used. However, the connector device, the receiving connector, and the inserting connector can be used as long as the electrical current is direct current (DC). In the case of direct current, unlike alternating current (AC), there may be no frequency which is safe for the human body.

In addition, from the view point of an effect on the human body, it is normal practice to use the voltage equal to or smaller than 48 V as a direct current voltage. This is because in a case where the direct current voltage is equal to or smaller than 48 V, there is almost no effect of electric shock on the human body. In a case where the direct current voltage is greater than 48 V, there is great effect on the human body. In particular, the voltage equal to or greater than 200 V is dangerous.

On the other hand, the connector device, the inserting connector and the receiving connector of the first embodiment of the present invention have a structure whereby safety properties are improved, in a case where the voltage is greater than 48 V, particularly equal to or greater than 200 V. In other words, since in the connector device, the inserting connector and the receiving connector of the first embodiment of the present invention, the safe properties are improved by a structure different from one of the related art, it is possible to achieve great effects in the case where the voltage is greater than 48 V, particularly equal to or greater than 200 V.

Second Embodiment

A second embodiment of the present invention relates to a receiving connector. More specifically, in the receiving connector, expansion and retraction of the control plug terminal is performed by a restoring force of a coil spring.

Figure 15:
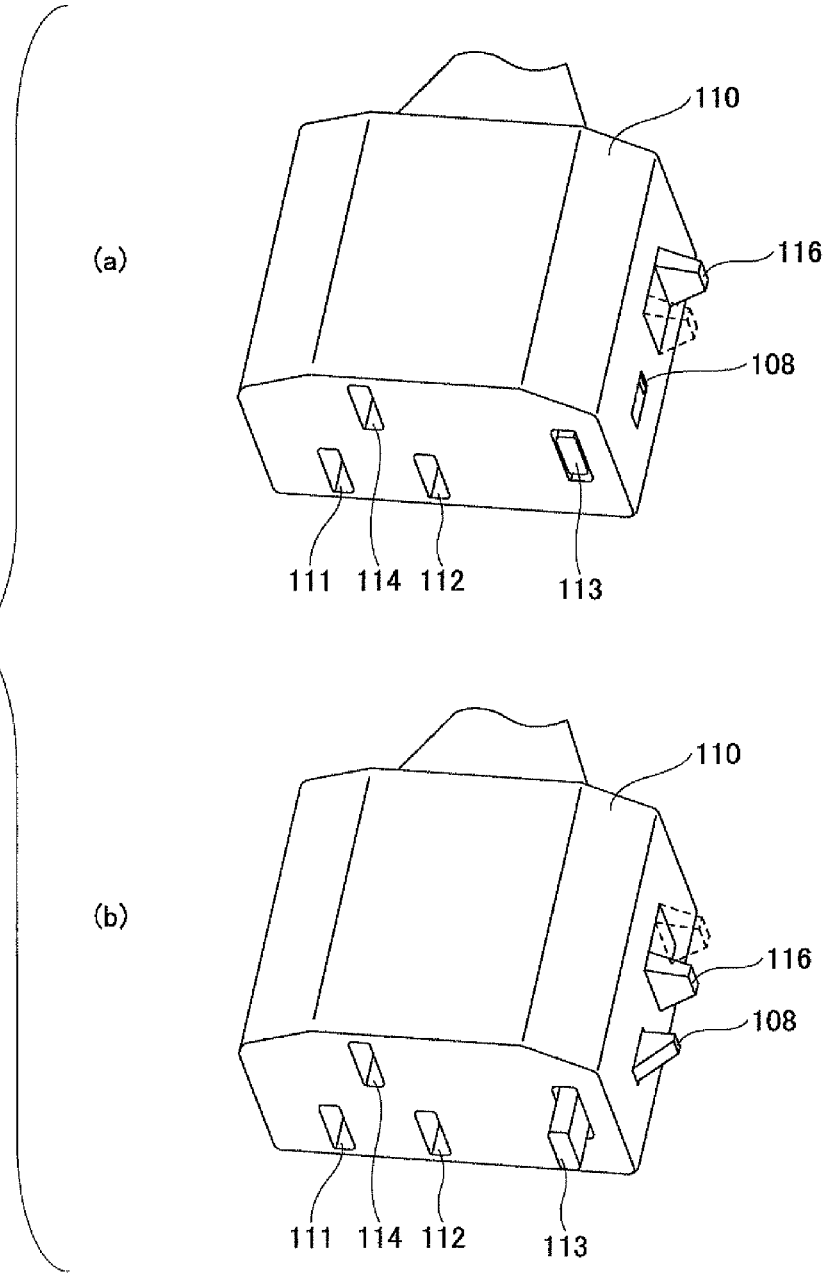
FIG. 15 is a perspective view of a receiving connector of a second embodiment of the present invention.

FIG. 15 shows a structure of a receiving connector of the second embodiment of the present invention. FIG. 15(*a*) is a perspective view of a receiving connector 110 in the retracted state where the control plug terminal 113 is retracted. FIG. 15(*b*) is a perspective view of a receiving connector 110 in the extended state where the control plug terminal 113 is extended.

The receiving connector 110 of the second embodiment of the present invention includes two electric power jack terminals 111 and 112 for receiving supply of the electric power, a control plug terminal 113, a ground jack terminal 114 for ground, a slide switch 116, and a lock terminal 108.

By sliding the slide switch 116 in the inserting direction of the control plug terminal 113 from the retracted state shown in FIG. 15(*a*) to the extended state shown in FIG. 15(*b*), the control plug terminal 113 is extended and the lock terminal 108 projects.

Next, a case where the control plug terminal 113 in the receiving connector 110 of the second embodiment of the present invention is extended is discussed with reference to FIG. 16 and FIG. 17. By extending the control plug terminal 113, the retracted state where the contact of the control switch provided in the control plug terminal of the inserting connector is opened is changed to the extended state where the contact of the control switch provided in the control plug terminal of the inserting connector is closed.

Figure 16:
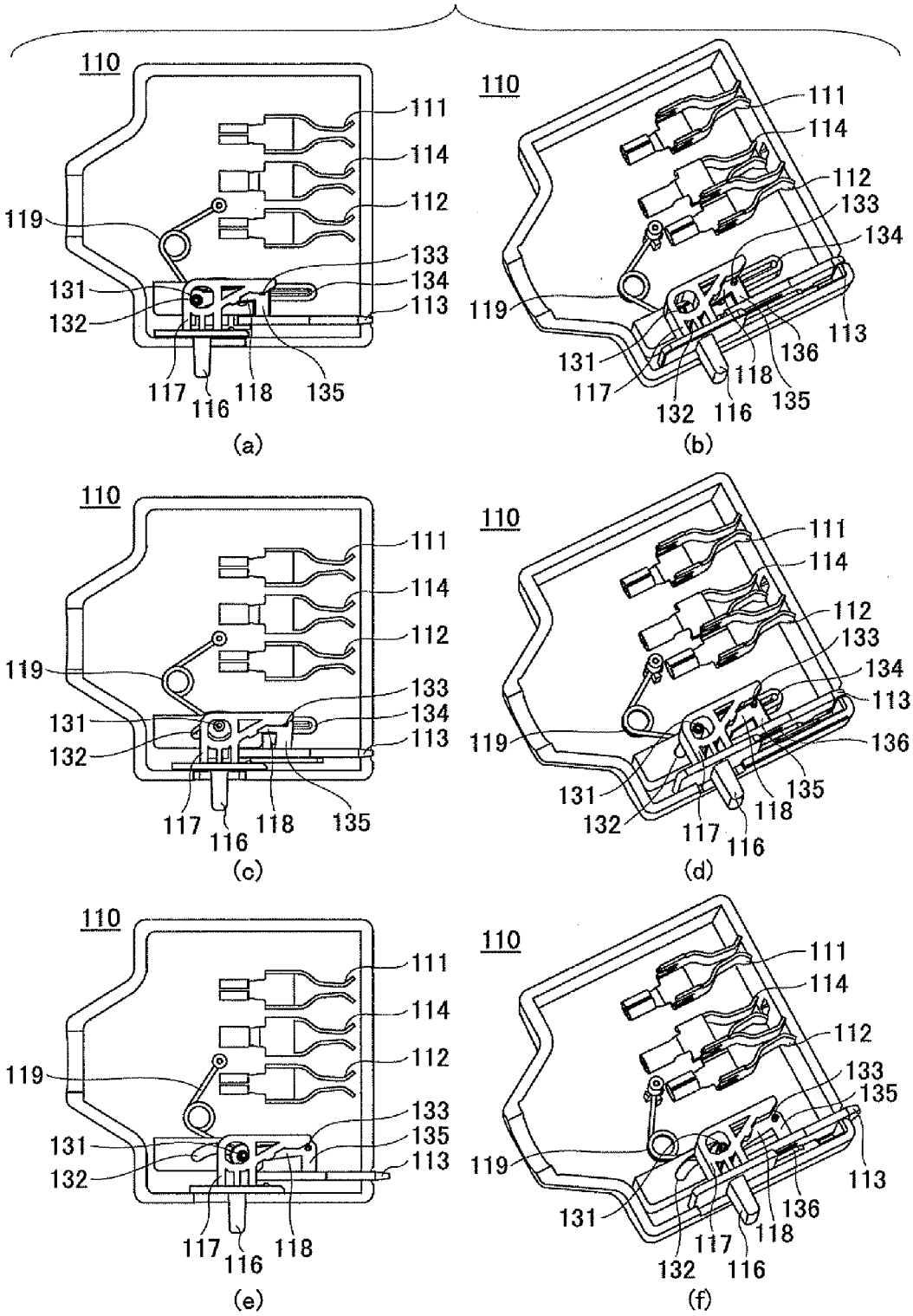
FIG. 16 is a view for explaining a case where a control plug terminal of the receiving connector of the second embodiment of the present invention is extended and retracted.
Figure 17:
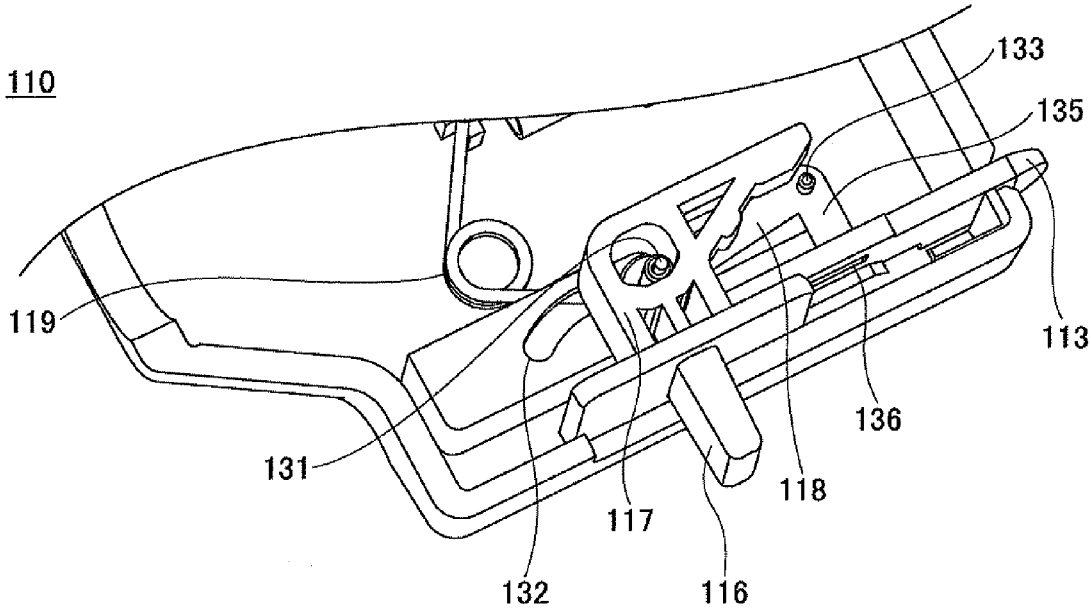
FIG. 17 is a perspective view of an internal structure of the receiving connector of the second embodiment of the present invention.

FIG. 16(*a*) is an internal structural view of the retracted state where the control plug terminal 113 is retracted. FIG. 16(*b*) is an internal perspective view of the retracted state where the control plug terminal 113 is retracted. FIG. 16(*c*) is an internal structural view of an intermediate state between where the control plug 10' terminal 113 is retracted and where the control plug terminal 113 is extended. FIG. 16(*d*) is an internal perspective view of the intermediate state between where the control plug terminal 113 is retracted and where the control plug terminal 113 is extended. FIG. 16(*e*) is an internal perspective view of the extended state where the control plug terminal 113 is extended. FIG. 16(*f*) is an internal perspective view of the extended state where the control plug terminal 113 is extended. FIG. 17 is a partial expanded view of FIG. 16(*f*).

As shown in FIG. 16(*a*) and FIG. 16(*b*), in the slide switch 116, a U-shaped part 117 is provided inside the receiving connector 110 and the control plug terminal 113 extends via a control plug terminal link 118.

In addition, a torsion coil spring (torsion spring) 119 is provided inside the receiving connector 110. The torsion spring 119 is fixed to a housing of the receiving connector 110 where one end of the torsion spring 119 can be rotated. Another end of the torsion spring 119 is rotatably connected to a cam shaft 131 of the control plug terminal link 118. The cam shaft 131 can be moved in the cam groove 132.

In addition, a slide shaft 133 is provided at the control plug terminal link 118 so that the slide shaft 133 can be moved in the slide groove 134. In addition, a head end part 135 of the control plug terminal link 118 is movably inserted in a buffer groove 136 provided at the control plug terminal 113.

In the retracted state where the control plug terminal 113 is retracted, the slide switch 116 is positioned at a left side of FIG. 16(*a*). The cam shaft 131 is positioned at a left-most side in the cam groove 132 and comes in contact with an internal side surface of a left side of the U-shaped part 117. In addition, the slide shaft 133 of the control plug terminal link 118 is positioned at a left side in the slide groove 134 and the head end part 135 comes in contact with a left end of the buffer groove 136. At this time, the torsion spring 119 is slightly bent (legs of the torsion spring are slightly closed) relative to a no-load condition.

After that, by moving the slide switch 116 in the inserting direction (right direction), the intermediate state shown in FIG. 16(*c*) and FIG. 16(*d*) is formed. In this intermediate state, the moving direction of the slide switch 116 is perpendicular to a direction of a line between both ends of the torsion spring 119, and the slide switch 116 is positioned substantially at a center of FIG. 16(*c*). The cam shaft 131 is pushed to a right side by the internal wail surface of a left side of the U-shaped part 117 so that the control plug terminal link 118 is moved to a right side in the cam groove 132 so as to be positioned in the center part. At this time, the head end part 135 of the control plug terminal link 118 is moved to a right side. However, since the head end part 135 is moved in the buffer groove 136 the control plug terminal 113 remains retracted. In this intermediate state, the torsion spring 119 is bent (the legs of the torsion spring are closed) more than that shown in FIG. 16(*a*) and FIG. 16(*b*) and the reinforcing force of the torsion spring 119 becomes strong.

After that, by moving the slide switch 116 in the inserting direction (right direction), the extended state shown in FIG. 16(*e*) and FIG. 16(*f*) is formed based on the reinforcing force of the torsion spring 119.

In other words, by the reinforcing force which makes legs of the torsion spring 119 open, the cam shaft 131 is moved in the right direction in the cam groove 132. As a result of this, the right end of the buffer groove 136 is pushed by the head end part 135 of the control plug terminal link 118 and the control plug terminal 113 is extended in the inserting direction.

In this extended state, the slide switch 116 is moved to a right side and the control plug terminal link 118 is also moved to a right side. In addition, the cam shaft 131 is moved to a right-most side in the cam groove 132 and comes in contact with the internal wall surface of a right side of the U-shaped part 117. Furthermore, the slide shaft 133 of the control plug terminal link 118 is moved to a right side in the slide groove 134 so that the head end part 135 comes in contact with the right end of the buffer groove 136. At this time, the legs of the torsion spring 119 open more than in the intermediate state.

Thus, it is possible to extend the control plug terminal 113 in the inserting direction. This can be done in a short period of time because the control plug terminal 113 is extended in the inserting direction by the reinforcing force of the torsion spring 119 from the intermediate state, namely a force due to the legs of the torsion spring 119 opening.

Next, a case where the control plug terminal 113 of the receiving connector 110 is retracted is discussed with reference to FIG. 16 and FIG. 17. In the retracted state where the control plug terminal 113 of the receiving connector 110 is retracted, a contact of the control switch provided in the control plug terminal of the inserting connector 20 is changed from being closed to being open.

As shown in FIG. 16(*e*) and FIG. 16(*f*), in the extended state where the control plug terminal 113 is extended, the slide switch 116 is positioned at a right side and the control plug terminal link 118 is also positioned at a right side. The cam shaft 131 is positioned at a right-most side in the cam groove 132 and comes in contact with the internal wall surface of the right side of the U-shaped part 117. Furthermore, the slide shaft 133 of the control plug terminal link 118 is positioned at the right side in the slide groove 134. The head end part 135 comes in contact with the right end of the buffer groove 136. At this time, the torsion spring 119 is slightly bent (legs of the torsion spring is slightly closed) relative to a no-load condition.

After this, by moving the slide switch 116 a pulling-out direction (left direction), the intermediate state shown in FIG. 16(*c*) and FIG. 16(*d*) is formed. In this intermediate state, the moving direction of the slide switch 116 is perpendicular to a direction of a line between both ends of the torsion spring 119.

In this intermediate state, the slide switch 116 is positioned substantially at a center in FIG. 16(*c*). The cam shaft 131 is pushed to a left side by the internal wall surface of a right side of the U-shaped part 117 so that the control plug terminal link 118 is moved to a left side in the cam groove 132 so as to be positioned in the center part. At this time, the head end part 135 of the control plug terminal link 118 is moved to a left side. However, since the head end part 135 is moved in the buffer groove 136 the control plug terminal 113 remains extended. In this intermediate state, the torsion spring 119 is bent (the legs of the torsion spring are closed) more than the extended state shown in FIG. 16(*e*) and FIG. 16(*f*) and the reinforcing force of the torsion spring 119 becomes strong.

After that, by moving the slide switch 116 in the pulling-out direction (left direction), the retracted state shown in FIG. 16(*a*) and FIG. 16(*b*) is formed based on the reinforcing force of the torsion spring 119.

In other words, by the reinforcing force which makes legs of the torsion spring 119 open, the cam shaft 131 is moved in the left direction in the cam groove 132. As a result of this, the left end of the buffer groove 136 is pushed by the head end part 135 of the control plug terminal link 118 and the control plug terminal 113 is retracted in the inserting direction.

In this retracted state, the slide switch 116 is moved to a left side and the control plug terminal link 118 is also moved to a left side. In addition, the cam shaft 131 is moved to a left side most in the cam groove 132 and comes in contact with the internal wall surface of a left side of the U-shaped part 117. Furthermore, the slide shaft 133 of the control plug terminal link 118 is moved to a left side in the slide groove 134 so that the head end part 135 comes in contact with the left end of the buffer groove 136. At this time, the legs of the torsion spring 119 open more than in the intermediate state.

Thus, it is possible to retract the control plug terminal 113 in the inserting direction. This can be done in a short period of time because the control plug terminal 113 is retracted in the inserting direction by the reinforcing force of the torsion spring 119 from the intermediate state, namely a force due to the legs of the torsion spring 119 opening.

In the meantime, in a case where the torsion spring 119 is not provided, although the control plug terminal 113 is extended or retracted in the inserting direction by only a force of a human finger, the speed of the extension or contraction may differ depending on the human and may be slow.

In this case, due to slowness of extending or retracting the control plug terminal 113, the arcing current or chattering may be generated at the contact of the inserting connector 20 with the control plug terminal 113. By the generation of the arcing current or chattering, the contacts of the inserting connector 20 may be damaged or the apparatus connected to the receiving connector 110 may be damaged.

On the other hand, in the receiving connector 110 of this embodiment, it is possible to extend or retract the plug terminal 113 in a short period of time. Hence, the generation of the arcing current or chattering can be prevented so that it is possible to prevent damage of the contact of the inserting connector 20 or destruction of the apparatus connected to the receiving connector 110.

On the other hand, although the average moving speed of the control plug terminal 113 is properly set depending on kinds or a structure of the control switch of the inserting connector, it is preferable to set the average moving speed of the control plug terminal 113 equal to or greater than 3 mm per second.

In the above explanation, a case where the control plug terminal 113 is retracted by using the reinforcing force due to the legs of the torsion spring 119 being changed from closed to open is discussed. However, the present invention is not limited to this example. The control plug terminal 113 can be extended or retracted by using the reinforcing force due to the legs of the torsion spring 119 being changed from open to closed based on the change of the structure or the like of the cam groove 132. In addition, the torsion spring 119 is used in this embodiment. However, an elastic body having any structure can be used as long as the same effect can be achieved.

The receiving connector of the second embodiment can be used instead of the receiving connector of the first embodiment. The combination of the inserting connector of the first embodiment and the receiving connector of the second embodiment can be used as a connector device.

Third Embodiment

Next, a connector device, a receiving connector, and an inserting connector of a third embodiment of the present invention are discussed.

Figure 18:
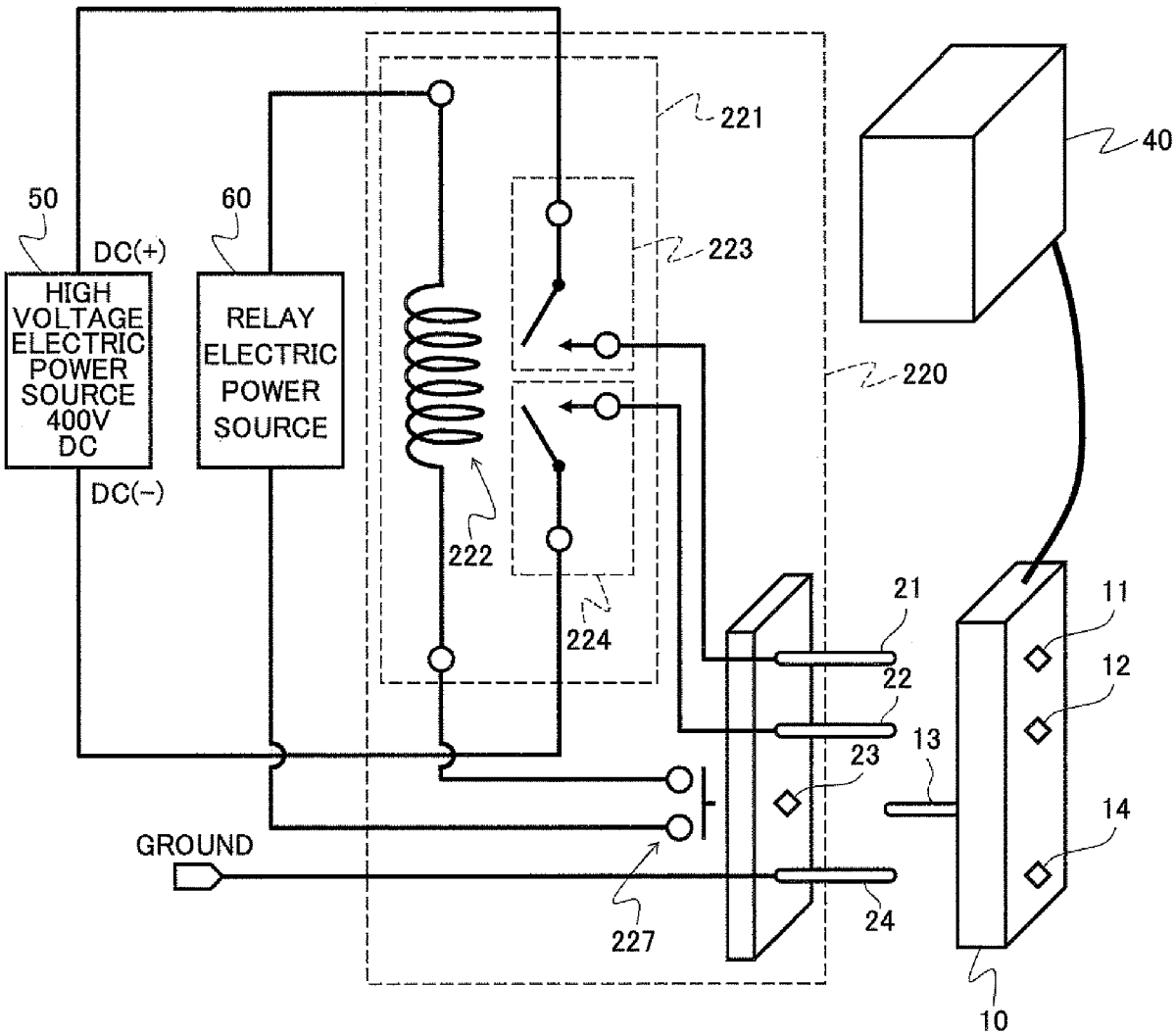
FIG. 18 is a structural view of a connector device of a third embodiment of the present invention.

FIG. 18 is a structural view of the connector device, the receiving connector, and the inserting connector of the third embodiment of the present invention. In FIG. 18, parts that are the same as the parts shown in FIG. 1 through FIG. 14 are given the same reference numerals, and explanation thereof is omitted.

The connector device of the third embodiment of the present invention includes the receiving connector 10 and an inserting connector 220. The inserting connector 220 is connected to the high voltage electric power source 50 configured to supply electric power.

The receiving connector 220 includes the electric power plug terminals 21 and 22, the control jack terminal 23, and the ground plug terminal 24. The electric power plug terminals 21 and 22 correspond to the electric power jack terminals 11 and 12. The control jack terminal 23 corresponds to the control plug terminal 13. The ground plug terminal 24 corresponds to the ground jack terminal 14.

A relay 221 is provided in the inserting connector 220. The relay 221 includes a single coil 222 and two relay contacts 223 and 224. By flowing the electric current to the coil 222, the relay contacts 223 and 224 are closed and each of them is connected. When the electric current does not flow into the coil 222, both of the relay contacts 223 and 224 are opened and neither of them is connected.

One end of the relay contact 223 is connected to a positive output of the high voltage electric power source 50 and another end of the relay contact 223 is connected to the electric power plug terminal 21. In addition, one end of the relay contact 224 is connected to a negative output of the high voltage electric power source 50 and another end of the relay contact 224 is connected to the electric power plug terminal 22.

A relay electric power source 60 configured to drive the relay 221 is connected to the inserting connector 220. In other words, one terminal of the coil 222 of the relay 221 and one terminal of the relay electric power source 60 are connected to each other. Another terminal of the coil 222 and another terminal of the relay electric power source 60 are connected to the control switch 227.

Where the receiving connector 10 and the inserting connector 220 are engaged with each other, by extending the control plug terminal 13 of the receiving connector 10, the control switch 227 is electrically connected.

Thus, by electrically connecting the control switch 227, the electrical current flows from the relay electric power source 60 to the coil 222 of the relay 221 and the relay contacts 223 and 224 are closed. As a result of this, the electric power is supplied to the electric power plug terminals 21 and 22 of the inserting connector 20. In addition, the electric power is supplied to the information device 40 such as the server via the electric power jack terminals 11 and 12 of the receiving connector 10.

In the connector device of the third embodiment of the present invention, the relay contacts 223 and 224 of the relay 221 is connected to the electric power plug terminals 21 and 22. This is because in a case of direct current electric power having a voltage greater than 48 V, especially a high voltage equal to or greater than 200 V, the likelihood of danger to the human body due to the contact may be extremely high. Accordingly, by connecting the relay contacts 223 and 224 to the electric power plug terminals 21 and 22, the electric power supply from both the electric power plug terminals 21 and 22 is controlled so that safety properties can be improved.

As discussed above, in this embodiment, the relay 221 is provided inside the main body of the inserting connector 220. However, the relay 221 may be provided outside the main body of the inserting connector 220.

Figure 19:
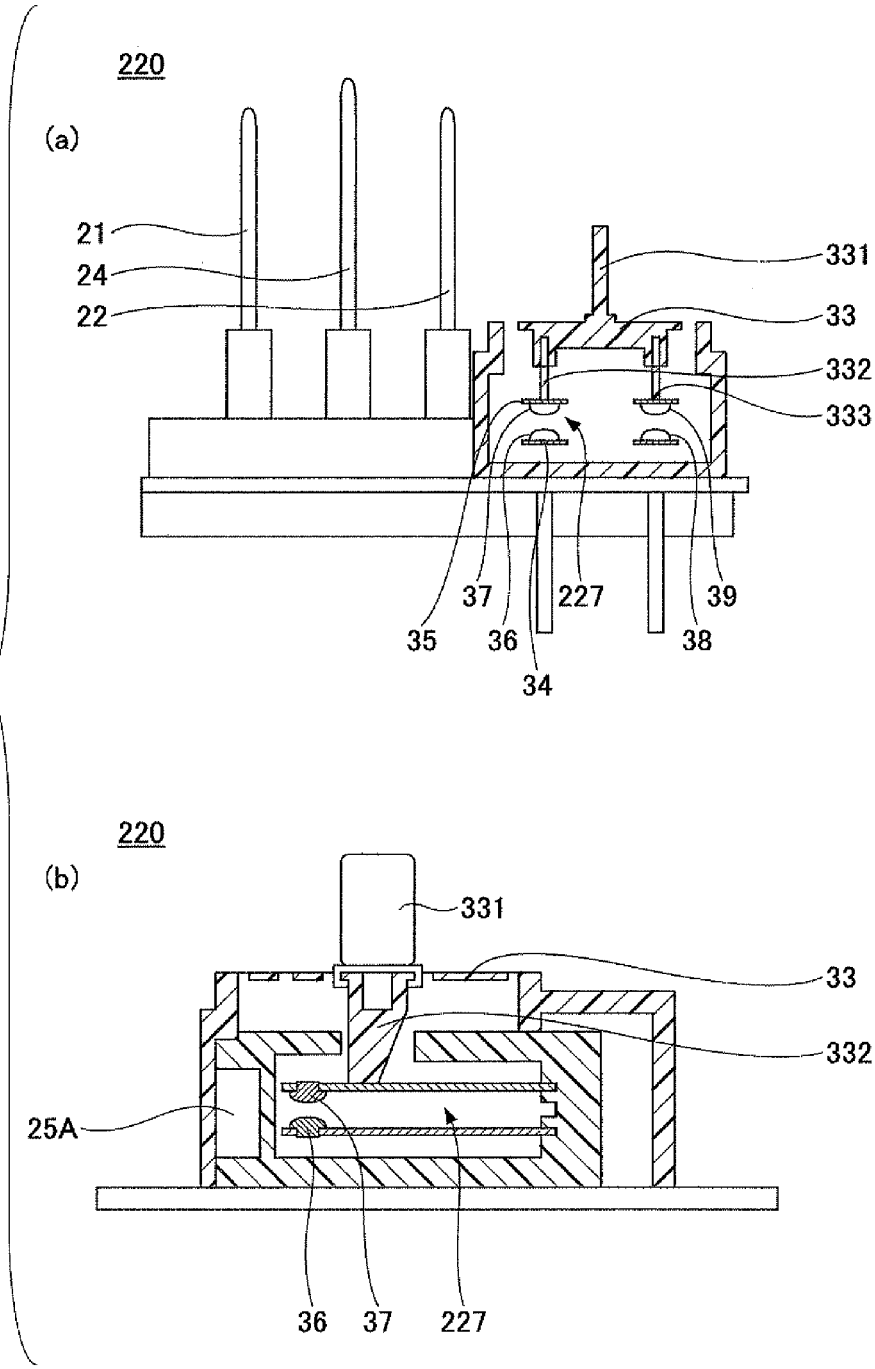
FIG. 19 is an internal structural view of a receiving connector of the third embodiment of the present invention.

FIG. 19 shows an internal structure of the inserting connector of the third embodiment of the present invention. In FIG. 19, parts that are the same as the parts shown in FIG. 1 through FIG. 14 are given the same reference numerals, and explanation thereof is omitted.

The inserting connector 220 of this embodiment includes the electric power plug terminals 21 and 22 and the ground plug terminal 24. A plate spring switch as a control switch 227 is provided, via the plate spring 33 which is an insulator, at a portion being the control jack terminal 23 corresponding to the control plug terminal 13.

The control switch 227 includes two switches. One switch has a structure where the contacts 36 and 37 are connected to each other. Another switch has a structure where the contacts 38 and 39 are connected to each other. In addition, for the purpose of prevention of the arcing current, the permanent magnet 25A is provided in the vicinities of the contacts 36 and 37. The permanent magnet 25B is provided in the vicinities of the contacts 38 and 39. The contacts 37 and 39 are electrically connected to each other. The contact 36 is connected to the relay electric power source 60 shown in FIG. 18. The contact 38 is connected to the coil 222 of the relay 221 shown in FIG. 18.

In the extended state where the control plug terminal 13 of the receiving connector 10 is extended, the plate spring 33 which is an insulator is bent so that the contacts 36 and 37 are connected to each other. At the same time, the contacts 38 and 39 are connected to each other. As a result of this, the contacts 36 and 38 are electrically connected so that the electric power is supplied from the relay electric power source 60. The electric current flows in the coil 222 of the relay 221 and the relay contacts 223 and 224 are connected (closed), and thereby the electric power is supplied, via the electric power plug terminals 21 and 22, from the high voltage electric power source 50.

The control switch 227 is not limited to a switch formed by itself. In other words, the control switch 227 may have any structure as long as another terminal of the coil 222 and another terminal of the relay electric power source 60 are connected to each other by extending the control plug terminal 13 in the inserting direction. More specifically, the following structure may be applied. That is, an electrode connected to another terminal of the coil 222 and another electrode connected to another terminal of the relay electric power source 60 are provided. The control plug terminal 13 is formed of a conductor. By extending the control plug terminal 13 in the inserting direction, the control plug terminal 13 comes in contact with both electrodes of the control switch 227. The other terminal of the coil 222 and the other terminal of the relay electric power source 60 are electrically connected to each other via the control plug terminal 13. In this case, the plate spring 33 which is an insulator is not necessary.

The connector device of this embodiment can be used for the electric power supply system discussed in the first embodiment of the present invention.

Fourth Embodiment

Next, a connector device, a receiving connector, and an inserting connector of a fourth embodiment of the present invention are discussed.

Figure 20:
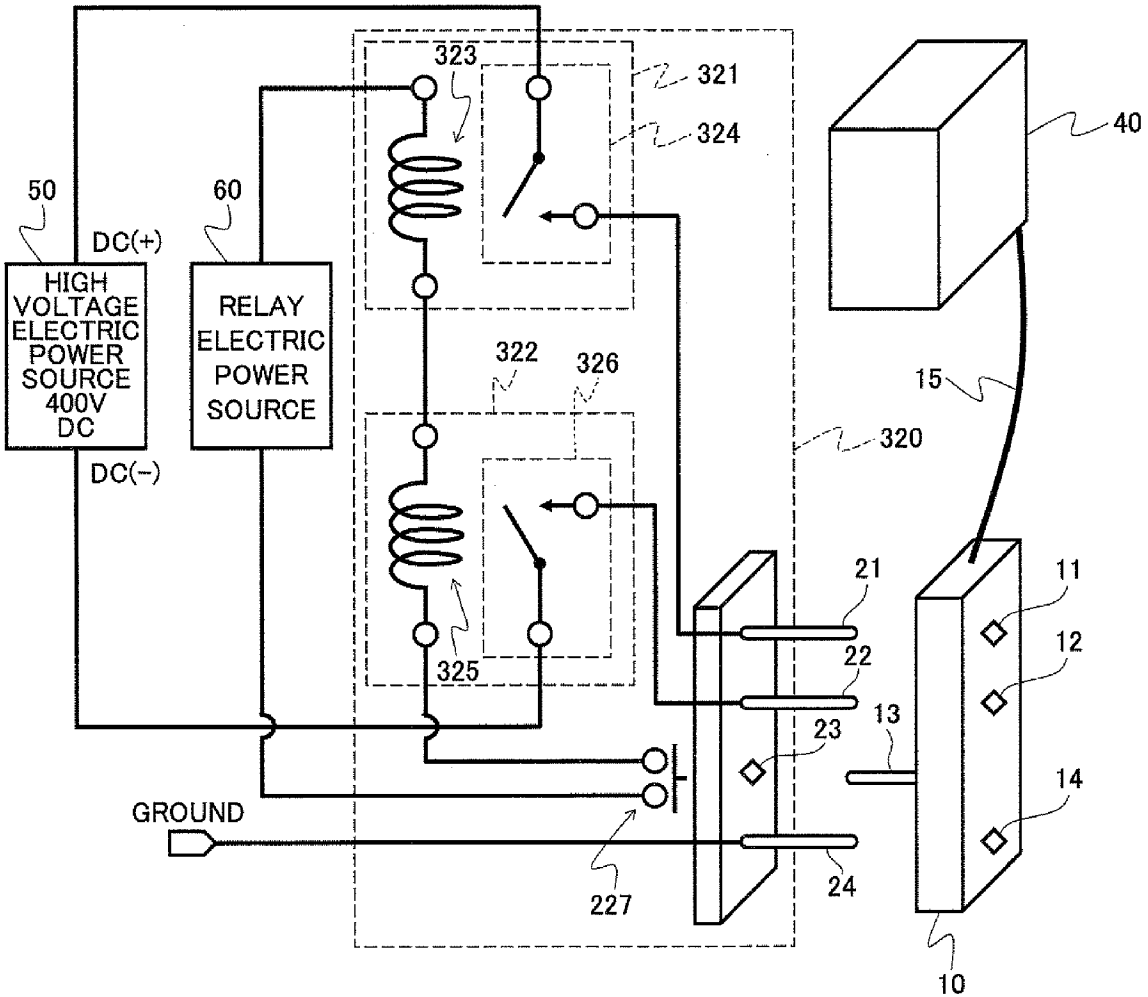
FIG. 20 is a structural view of a connector device of a fourth embodiment of the present invention.

FIG. 20 is a structural view of the connector device, the receiving connector, and the inserting connector of the fourth embodiment of the present invention. In FIG. 20, parts that are the same as the parts shown in FIG. 1 through FIG. 14 are given the same reference numerals, and explanation thereof is omitted. Since the internal structure of the inserting connector 320 is the same as that shown in FIG. 19, illustration thereof is omitted in FIG. 20.

The connector device of the fourth embodiment of the present invention includes the receiving connector 10 and an inserting connector 320. The inserting connector 320 is connected to the high voltage electric power source 50 configured to supply electric power.

The receiving connector 320 includes the electric power plug terminals 21 and 22, the control jack terminal 23, and the ground plug terminal 24. The electric power plug terminals 21 and 22 correspond to the electric power jack terminals 11 and 12. The control jack terminal 23 corresponds to the control plug terminal 13. The ground jack terminal 24 corresponds to the ground jack terminal 14.

Two relays 321 and 322 are provided in the inserting connector 320. The relay 321 includes a coil 3232 and a relay contact 324. By flowing of the electric current through the coil 323, the relay contact 324 is closed and connected. When the electric current does not flow into the coil 323, the relay contact 324 is opened and not connected.

In addition, the relay 322 includes a coil 325 and a relay contact 326. By flowing of the electric current through the coil 325, the relay contact 326 is closed and connected. When the electric current does not flow into the coil 325, the relay contact 326 is opened and not connected.

One end of the relay contact 324 is connected to a positive output of the high voltage electric power source 50 and another end of the relay contact 324 is connected to the electric power plug terminal 21. In addition, one end of the relay contact 326 is connected to a negative output of the high voltage electric power source 50 and another end of the relay contact 326 is connected to the electric power plug terminal 22.

A relay electric power source 60 configured to drive the relays 321 and 322 is connected to the inserting connector 320. More specifically, one terminal of the coil 323 of the relay is connected to one terminal of the coil 325 of the relay 322. The coil 323 of the relay 321 and the coil 325 of the relay 322 are connected in series. Furthermore, another terminal of the coil 323 and one terminal of the relay electric power source 60 are connected to each other. Another terminal of the coil 325 and another terminal of the relay electric power source 60 are connected to the control switch 227.

In the control switch 227, in the engaging state where the receiving connector 10 and the inserting connector 320 are engaged with each other, by extending the control plug terminal 13 of the receiving connector 10, electrical contact is made.

Thus, by electrically connecting the control switch 227, the electrical current flows from the relay electric power source 60 to the coils 323 and 325 of the relays 321 and 322 and the relay contacts 324 and 326 are closed. As a result of this, the electric power is supplied to the electric power plug terminals 21 and 22 of the inserting connector 320. In addition, the electric power is supplied to the information device 40 such as the server via the electric power jack terminals 11 and 12 of the receiving connector 10.

In the connector device of the fourth embodiment of the present invention, the relay contacts 324 and 326 of the relays 321 and 322 are connected to the electric power plug terminals 21 and 22, respectively. This is because in a case of direct current electric power having a voltage greater than 48 V, especially a high voltage equal to or greater than 200 V, the likelihood of danger to the human body due to the contact may be extremely high. Accordingly, by connecting the relay contacts 324 and 326 to the electric power plug terminals 21 and 22, the electric power supply from both the electric power plug terminals 21 and 22 is controlled so that safety properties can be improved.

As discussed above, in this embodiment, the relays 321 and 322 are provided inside the main body of the connector 320. However, the relays 321 and 322 may be provided outside the main body of the connector 320.

The connector device of this embodiment can be used for an electric power supply system discussed in the first embodiment of the present invention.

Thus, according to the above-discussed embodiments of the present invention, it is possible to provide a connector device, a receiving connector, and an inserting connector whereby electric power having a high voltage can be safely supplied.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

What is claimed is:

1. A connector device configured to electrically connect an electric power source and an electronic device which receives a supply of electric power from the electric power source, the connector device comprising:

an inserting connector and a receiving connector, wherein the receiving connector is connected to the electronic device;

the receiving connector includes a single control plug terminal and two electric power jack terminals made of a conductor material, the electric power jack terminals being configured to receive the supply of the electric power;

the control plug terminal can be extended and retracted in an inserting direction of the receiving connector;

the inserting connector is connected to the electric power source;

the inserting connector includes a control jack terminal corresponding to the control plug terminal and two electric power plug terminals corresponding to the two electric power jack terminals;

the control jack terminal includes a control switch; and in a state where the two electric power plug terminals and the two electric power jack terminals are engaged with each other, by extending the control plug terminal to the control jack terminal in the inserting direction, a contact of the control switch is connected so that the electric power is supplied to the electronic device.

2. The connector device as claimed in claim 1, wherein the number of the control switches to be provided is two;

the two control switches are connected to the two electric power plug terminals, respectively; and the electric power source is configured to supply the electric power from the electric power plug terminals via the two control switches.

3. The connector device as claimed in claim 1, wherein the inserting connector further includes a relay connected to the control switch; and when the contact of the control switch is connected, the relay is operated so that the electric power is supplied to the electronic device.

4. The connector device as claimed in claim 3, wherein the relay includes at least one coil and two relay contacts;

the two relay contacts are connected concurrently when an electric current flows in the coil;

the two relay contacts are connected to the two electric power plug terminals;

the electric power source is configured to supply the electric power from the electric power plug terminals via the relay contacts; and when the contact of the control switch is connected, the electric current flows in the coil and the two relay contacts are connected so that the electric power is supplied to the electronic device.

5. The connector device as claimed in claim 3, wherein the number of the relays to be provided is two;

each of the relays includes a single coil and a single relay contact;

when the electric current flows in the coils, the relay contacts are connected;

the relay contacts of the two relay are connected to the two electric power plug terminals, respectively;

the electric power source is configured to supply the electric power from the electric power plug terminals via the relay contacts; and when the contact of the control switch is connected, the electric current flows in the coils and the relay contacts are connected so that the electric power is supplied to the electronic device.

6. The connector device as claimed in claim 1, wherein extension or retraction of the control plug terminal in the inserting direction is performed by a slide switch or a push-button.

7. The connector device as claimed in claim 1, further comprising:

a slide switch configured to perform extension and retraction of the control plug terminal in the inserting direction via a control plug terminal link; and a torsion spring, wherein the control plug terminal is in an intermediate state where the moving direction of the slide switch is perpendicular to a direction of a line between both ends of the torsion spring; and the torsion spring is bent by moving the slide switch.

8. The connector device as claimed in claim 7, wherein the torsion spring is bent in the intermediate state; and by a reinforcing force of the torsion spring, the control plug terminal is extended in the inserting direction, via the control plug terminal link, from the intermediate state.

9. The connector device as claimed in claim 7, wherein the torsion spring is bent in the intermediate state; and by a reinforcing force of the torsion spring, the control plug terminal is retracted in the inserting direction, via the control plug terminal link, from the intermediate state.

10. The connector device as claimed in claim 1, wherein the receiving connector includes a lock terminal configured to project in a direction perpendicular to the inserting direction as corresponding to extension and retraction of the control plug terminal in the inserting direction;

the lock terminal projects in the direction perpendicular to the inserting direction by pushing the control plug terminal in the inserting direction;

the inserting connector includes a concave part having a configuration corresponding to the projecting lock terminal; and the lock terminal is fitted in the concave part of the inserting connector in the direction perpendicular to the inserting direction by extending the control plug terminal when the receiving connector and the inserting connector are engaged with each other, so that an engaging state of the receiving connector and the inserting connector is maintained.

11. The connector device as claimed in claim 1, wherein the receiving connector includes a ground jack terminal;

the inserting connector includes a ground plug terminal corresponding to the ground jack terminal; and the ground plug terminal and the ground jack terminal are engaged with each other when the receiving connector and the inserting connector are engaged with each other.

12. The connector device as claimed in claim 1, wherein the electric power supplied from the electric power source is of a direct current.

13. The connector device as claimed in claim 1, wherein a voltage of the electric power supplied from the electric power source is greater than 48 V.

14. A receiving connector configured to be connected to an inserting connector, the inserting connector being configured to electrically connect an electric power source and an electronic device receiving a supply of electric power from the electric power source, the receiving connector being connected to the electronic device, the receiving connector comprising:

a control plug terminal; and two electric power jack terminals made of a conductor material, the electric power jack terminals being configured to receive the supply of the electric power, wherein the control plug terminal can be extended and retracted in an inserting direction of the receiving connector;

the inserting connector is connected to the electronic device;

the inserting connector includes a control jack terminal corresponding to the control plug terminal and two electric power plug terminals corresponding to the two electric power jack terminals;

the control jack terminal includes a control switch; and when the two electric power plug terminals and the two electric power jack terminals are engaged with each other, by extending the control plug terminal to the control jack terminal in the inserting direction, a contact of the control switch is connected so that the electric power is supplied to the electronic device.

15. The receiving connector as claimed in claim 14, wherein the number of the control switches to be provided is two;

the two control switches are connected to the two electric power plug terminals, respectively; and the electric power source is configured to supply the electric power from the electric power plug terminals via the two control switches.

16. The receiving connector as claimed in claim 14, wherein the inserting connector further includes a relay connected to the control switch; and when the contact of the control switch is connected, the relay is operated so that the electric power is supplied to the electronic device.

17. The receiving connector as claimed in claim 14, wherein extension or retraction of the control plug terminal in the inserting direction is performed by a slide switch or a push-button.

18. The receiving connector as claimed in claim 14, further comprising:

a slide switch configured to perform extension and retraction of the control plug terminal in the inserting direction via a control plug terminal link; and a torsion spring, wherein the control plug terminal is in an intermediate state where the moving direction of the slide switch is perpendicular to a direction of a line between both ends of the torsion spring; and the torsion spring is bent by moving the slide switch.

19. The receiving connector as claimed in claim 18, wherein the torsion spring is bent in the intermediate state; and by a reinforcing force of the torsion spring, the control plug terminal is extended in the inserting direction, via the control plug terminal link, from the intermediate state.

20. The receiving connector as claimed in claim 18, wherein the torsion spring is bent in the intermediate state; and by a reinforcing force of the torsion spring, the control plug terminal is retracted in the inserting direction, via the control plug terminal link, from the intermediate state.

21. The receiving connector as claimed in claim 18, wherein the receiving connector includes a lock terminal configured to project in a direction perpendicular to the inserting direction as corresponding to extension and retraction of the control plug terminal in the inserting direction;

the lock terminal projects in the direction perpendicular to the inserting direction by pushing the control plug terminal in the inserting direction;

the inserting connector includes a concave part having a configuration corresponding to the projecting lock terminal; and the lock terminal is fitted in the concave part of the inserting connector in the direction perpendicular to the inserting direction by extending the control plug terminal when the receiving connector and the inserting connector are engaged with each other, so that an engaging state of the receiving connector and the inserting connector is maintained.

22. The receiving connector as claimed in claim 14, wherein the receiving connector includes a ground jack terminal;

the inserting connector includes a ground plug terminal corresponding to the ground jack terminal; and the ground plug terminal and the ground jack terminal are engaged with each other when the receiving connector and the inserting connector are engaged with each other.

23. The receiving connector as claimed in claim 14, wherein the electric power supplied from the electric power source is of a direct current.

24. The receiving connector as claimed in claim 14, wherein a voltage of the electric power supplied from the electric power source is greater than 48 V.

25. An inserting connector configured to be connected to a receiving connector, the receiving connector being configured to electrically connect an electric power source and an electronic device receiving a supply of electric power from the electric power source, the inserting connector being connected to the electronic power source, the inserting connector comprising:

a control jack terminal corresponding to a control plug terminal of the receiving connector; and two electric power plug terminals corresponding to two electric power jack terminals of the receiving connector, the electric power jack terminals being made of a conductor material and configured to receive the supply of the electric power, wherein the control plug terminal can be extended and retracted in an inserting direction of the receiving connector;

the receiving connector is connected to the electronic device;

the control jack terminal includes a control switch; and in a state where the two electric power plug terminals and the two electric power jack terminals are engaged with each other, respectively, by extending the control plug terminal to the control jack terminal in the inserting direction, a contact of the control switch is connected so that the electric power is supplied to the electronic device.

26. The inserting connector as claimed in claim 25, wherein the number of the control switches to be provided is two;

the two control switches are connected to the two electric power plug terminals; and the electric power source is configured to supply the electric power from the electric power plug terminals via the two control switches.

27. The inserting connector as claimed in claim 25, further comprising:

a relay connected to the control switch;

wherein, when the contact of the control switch is connected, the relay is operated so that the electric power is supplied to the electronic device.

28. The inserting connector as claimed in claim 27, wherein the relay includes at least one coil and two relay contacts;

the two relay contacts are connected concurrently when an electric current flows in the coil;

the two relay contacts are connected to the two electric power plug terminals;

the electric power source is configured to supply the electric power from the electric power plug terminals via the relay contacts; and when the contact of the control switch is connected, the electric current flows in the coil and the two relay contacts are connected so that the electric power is supplied to the electronic device.

29. The inserting connector as claimed in claim 27, wherein the number of the relays to be provided is two;

each of the relays includes a single coil and a single relay contact;

when the electric current flows in the coils, the relay contacts are connected;

the relay contacts of the two relays are connected to the two electric power plug terminals, respectively;

the electric power source is configured to supply the electric power from the electric power plug terminals via the relay contacts; and when the contact of the control switch is connected, the electric current flows in the coils and the relay contacts are connected so that the electric power is supplied to the electronic device.

30. The inserting connector as claimed in claim 25, wherein the receiving connector includes a lock terminal configured to project in a direction perpendicular to the inserting direction corresponding to the extension and the retraction of the control plug terminal in the inserting direction;

the lock terminal projects in the direction perpendicular to the inserting direction by pushing of the control plug terminal in the inserting direction;

the inserting connector includes a concave part having a configuration corresponding to the projecting lock terminal; and the lock terminal is fitted in the concave part of the inserting connector in the direction perpendicular to the inserting direction by extending the control plug terminal when the receiving connector and the inserting connector are engaged with each other, so that an engaging state of the receiving connector and the inserting connector is maintained.

31. The inserting connector as claimed in claim 25, wherein the receiving connector includes a ground jack terminal;

the inserting connector includes a ground plug terminal corresponding to the ground jack terminal; and the ground plug terminal and the ground jack terminal are engaged with each other when the receiving connector and the inserting connector are engaged with each other.

32. The inserting connector as claimed in claim 25, wherein the electric power supplied from the electric power source is of a direct current.

33. The inserting connector as claimed in claim 25, wherein a voltage of the electric power supplied from the electric power source is greater than 48 V.

* * * * *